US010585379B2

(12) United States Patent
Saito et al.

(10) Patent No.: US 10,585,379 B2
(45) Date of Patent: Mar. 10, 2020

(54) IMAGE FORMING APPARATUS THAT DETECTS AN ABNORMALITY IN A HEATER BASED ON TEMPERATURES DETECTED BY TEMPERATURE DETECTION PORTIONS

(71) Applicant: CANON KABUSHIKI KAISHA, Tokyo (JP)

(72) Inventors: Yusuke Saito, Susono (JP); Ryota Ogura, Numazu (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/192,171

(22) Filed: Nov. 15, 2018

(65) Prior Publication Data

US 2019/0155199 A1 May 23, 2019

(30) Foreign Application Priority Data

Nov. 20, 2017 (JP) ..... 2017-223014

(51) Int. Cl.
*G03G 15/20* (2006.01)
*G03G 15/00* (2006.01)
*H05B 3/20* (2006.01)

(52) U.S. Cl.
CPC ..... *G03G 15/2039* (2013.01); *G03G 15/55* (2013.01); *H05B 3/20* (2013.01); *G03G 15/80* (2013.01)

(58) Field of Classification Search
CPC ..... G03G 15/5004; G03G 15/2039; G03G 15/2053; G03G 15/2021; G03G 15/2042;
(Continued)

(56) References Cited

U.S. PATENT DOCUMENTS 4,740,671 A * 4/1988 Kuroda ..... G05D 23/24 219/492
5,274,423 A * 12/1993 Kusumoto ..... G03G 15/2003 399/320

(Continued)

FOREIGN PATENT DOCUMENTS

JP 04276784 A * 10/1992
JP 2000-122489 A 4/2000

(Continued)

*Primary Examiner* — Robert B Beatty
(74) *Attorney, Agent, or Firm* — Venable LLP

(57) ABSTRACT

An image forming apparatus includes a heater including a heating element, a driving unit that supplies electrical power to the heating element, and a plurality of temperature detection portions, each detecting a temperature of the heater, and being disposed on a first circuit. A control unit controls the driving unit based on the temperatures detected by the plurality of temperature detection portions, the control unit being disposed on a second circuit, which is isolated from the first circuit. A plurality of abnormality detection circuit portions output signals corresponding to the temperatures detected by the plurality of temperature detection portions, and are disposed on the first circuits. In addition, an abnormality transmission circuit portion transmits a signal indicating an abnormality in the heater to the control unit based on the signals output by the abnormality detection circuit portions.

15 Claims, 17 Drawing Sheets

(58) Field of Classification Search
CPC ..... G03G 15/80; G03G 15/55; H05B 3/28; H05B 3/20; H05B 1/0241
USPC ..... 399/33, 69; 219/216, 483, 508
See application file for complete search history.

(56) References Cited

U.S. PATENT DOCUMENTS

| | | | | |
|---|---|---|---|---|
| 7,332,692 | B2 * | 2/2008 | Bourget | B05C 5/001 219/481 |
| 2004/0265021 | A1 * | 12/2004 | Kinouchi | G03G 15/2042 399/334 |
| 2008/0118265 | A1 * | 5/2008 | Kinouchi | G03G 15/5004 399/70 |
| 2010/0150595 | A1 * | 6/2010 | Harris | G03G 15/5004 399/69 |
| 2014/0086600 | A1 * | 3/2014 | Cui | G03G 21/20 399/33 |
| 2014/0169811 | A1 * | 6/2014 | Shimura | G03G 15/2039 399/33 |
| 2017/0199486 | A1 * | 7/2017 | Tanaka | G03G 15/2017 |
| 2018/0032009 | A1 | 2/2018 | Ogura | |

FOREIGN PATENT DOCUMENTS

| | | | |
|---|---|---|---|
| JP | 2002-170649 | A | 6/2002 |
| JP | 2002-351253 | A | 12/2002 |
| JP | 2007-052176 | A | 3/2007 |

* cited by examiner

IMAGE FORMING APPARATUS THAT DETECTS AN ABNORMALITY IN A HEATER BASED ON TEMPERATURES DETECTED BY TEMPERATURE DETECTION PORTIONS

This application claims the benefit of Japanese Patent Application No. 2017-223014, filed Nov. 20, 2017, which is hereby incorporated by reference herein in its entirety.

BACKGROUND OF THE INVENTION

Field of the Invention

The present invention relates to an image heating device, such as a fixing unit, mounted in an image forming apparatus, such as a copying machine or a printer, which uses an electrophotographic system or an electrostatic recording system, and a gloss providing device that improves a gloss level of a toner image by re-heating the toner image fixed to a recording material. The present invention also relates to an image forming apparatus including the image heating device.

Description of the Related Art

A method that uses a temperature detection element is known as means for protecting an image heating device having heating elements. Abnormal temperature detection unit outputs an electrical signal when a temperature based on temperature information detected by the temperature detection element is abnormal. In response to this output signal, an interruption portion interrupts the supply of electrical power to the heating elements to prevent damage of the apparatus. Japanese Patent Application Publication No. 2002-170649 proposes the above method and a method of eliminating the need to provide a distance between a primary-side heating element and a temperature detection element to realize a cost reduction and a size reduction.

In the conventional configuration, however, since a number of photocouplers corresponding to the number of temperature detection elements are required and the number of components increases, the cost and a component mounting area increase.

SUMMARY OF THE INVENTION

An object of the present invention is to provide an image forming apparatus capable of preventing damage to the apparatus with an inexpensive configuration, without increasing a configuration for transmitting an abnormality in a heater more than necessary in a configuration having a plurality of temperature detection elements.

In order to achieve the object described above, in one aspect, the invention provides an image forming apparatus that includes a heater including a heating element that generates heat by energization, a driving unit that supplies electrical power to the heating element, a plurality of temperature detection portions each detecting a temperature of the heater, the plurality of temperature detection portions being disposed on a first potential side, a control unit that controls the driving unit on the basis of the temperatures detected by the temperature detection portions, the control unit being disposed on a second potential side isolated from the first potential side, a plurality of abnormality detection circuit portions that output signals corresponding to the temperatures detected by the plurality of temperature detection portions, the plurality of abnormality detection circuit portions being disposed on the first potential side, and an abnormality transmission circuit portion that transmits a signal indicating an abnormality in the heater to the control unit on the basis of the signals output by the abnormality detection circuit portions, wherein the abnormality transmission circuit portion transmits the signal indicating the abnormality in the heater to the control unit on the basis of at least one of the signals output by the plurality of abnormality detection circuit portions.

In order to achieve the object described above, in another aspect, the invention provides an image forming apparatus that includes a heater including a heating element that generates heat by energization, the heater being connected to a primary-side circuit including an alternating current (AC) power supply, a driving unit that supplies electrical power to the heating element, the driving unit being connected to a secondary-side circuit isolated from the primary-side circuit, a plurality of temperature detection portions each detecting a temperature of the heater, the plurality of temperature detection portions being connected to a potential side isolated from the primary-side circuit and the secondary-side circuit, a plurality of abnormality detection circuit portions that output signals corresponding to the temperatures detected by the plurality of temperature detection portions, the plurality of abnormality detection circuit portions being disposed on a potential side isolated from the primary-side circuit and the secondary-side circuit, and a relay having a coil connected to a potential side isolated from the primary-side circuit and the secondary-side circuit, the relay having a contact on a conduction path to the heater in the primary-side circuit, wherein the relay is disconnected according to the signals output by the abnormality detection circuit portions.

According to the present invention, it is possible to prevent damage of an apparatus with an inexpensive configuration without increasing a configuration for transmitting an abnormality in a heater more than necessary in a configuration having a plurality of temperature detection elements.

Further features of the present invention will become apparent from the following description of exemplary embodiments with reference to the attached drawings.

DESCRIPTION OF THE EMBODIMENTS

Figure 1:
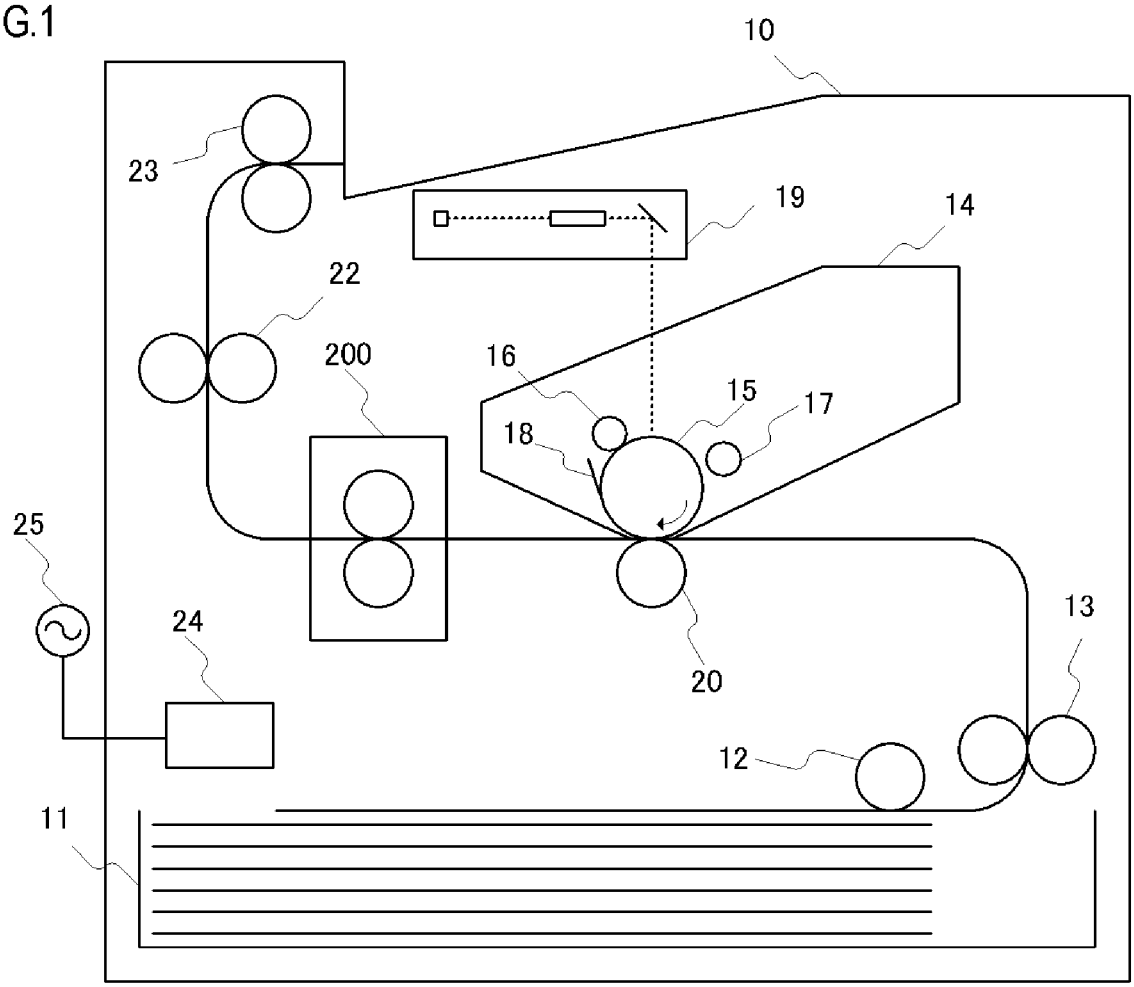
FIG. 1 is a schematic cross-sectional view of an image forming apparatus according to Embodiments 1 to 3.

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Embodiment 1

An image forming apparatus 10 according to Embodiment 1 of the present invention eliminates the need to provide a safety distance and achieves a size reduction by arranging a heating element (a resistance heating element) 302 and thermistors T1 to T4 on a primary side, and not arranging secondary-side elements in a fixing device 200 as an image heating device. In such a configuration, the output of abnormality detection portions a to d based on the temperature information of a plurality of thermistors T1 to T4 detecting the temperature of the heating element 302 is OR-connected to an abnormality transmission portion 408 or an abnormality transmission portion 409. When any one of the abnormality detection portions a to d operates, the supply of electrical power to the heating element 302 stops. The above is a characteristic configuration of the present embodiment.

Configuration of Image Forming Apparatus

FIG. 1 is a schematic diagram illustrating an example of a laser beam printer of an electrophotographic system as an image forming apparatus according to the present embodiment. An image forming operation of the image forming apparatus 10 will be described. Sheets P as a recording material are fed from a sheet feeding tray 11 one by one by a sheet feeding roller 12, and are transported to a process cartridge 14 at a predetermined timing by a transport roller 13. The process cartridge 14 has a photosensitive drum 15 as an image bearing member, a charging portion 16, and a developing unit 17. The charging portion 16 is in pressure-contact with the photosensitive drum 15, and the surface of the photosensitive drum 15 is uniformly charged by the charging portion 16. After that, a scanner unit 19, which is exposure unit, performs exposure based on image information and an electrostatic latent image is formed on the surface of the photosensitive drum 15. The developing unit 17 is provided closer to the downstream side in the rotation direction of the photosensitive drum 15 than an exposure position. When an electrostatic latent image formed on the photosensitive drum 15 reaches a position facing the developing unit 17, toner is supplied to the developing unit 17 to the electrostatic latent image and a toner image (a visible image) is formed on the photosensitive drum 15.

The sheet P is transported at a timing synchronized with a moving speed of the toner image formed on the photosensitive drum 15, and onto the sheet P, having reached the photosensitive drum 15, the toner image is transferred at a transfer nip formed by a pressure-contact portion between the photosensitive drum 15 and a transfer roller 20. After that, the sheet P, onto which the toner image is transferred, is transported to the fixing device 200 as a fixing unit having a heating element. The fixing device 200 includes two rollers that face each other and are in pressure-contact with each other to fix the toner image on the sheet P with heat and pressure. Electrical power is supplied to the fixing device 200 from an electrical power supply unit 24 connected to a commercial alternating current (AC) power supply 25 to heat the heating element inside the fixing device 200. After that, the sheet P is discharged outside the apparatus 10 by sheet discharge rollers 22 and 23 and a series of print operations end. Reference numeral 18 indicates a cleaning portion for cleaning the photosensitive drum 15.

The image forming apparatus 10 is not limited to that illustrated in FIG. 1, and may be an image forming apparatus including a plurality of image forming units, for example. Furthermore, the image forming apparatus 10 may include a primary transfer unit that transfers the toner image on the photosensitive drum 15 to an intermediate transfer belt, and a secondary transfer unit that transfers the toner image on the intermediate transfer belt to a sheet P.

Figure 2:
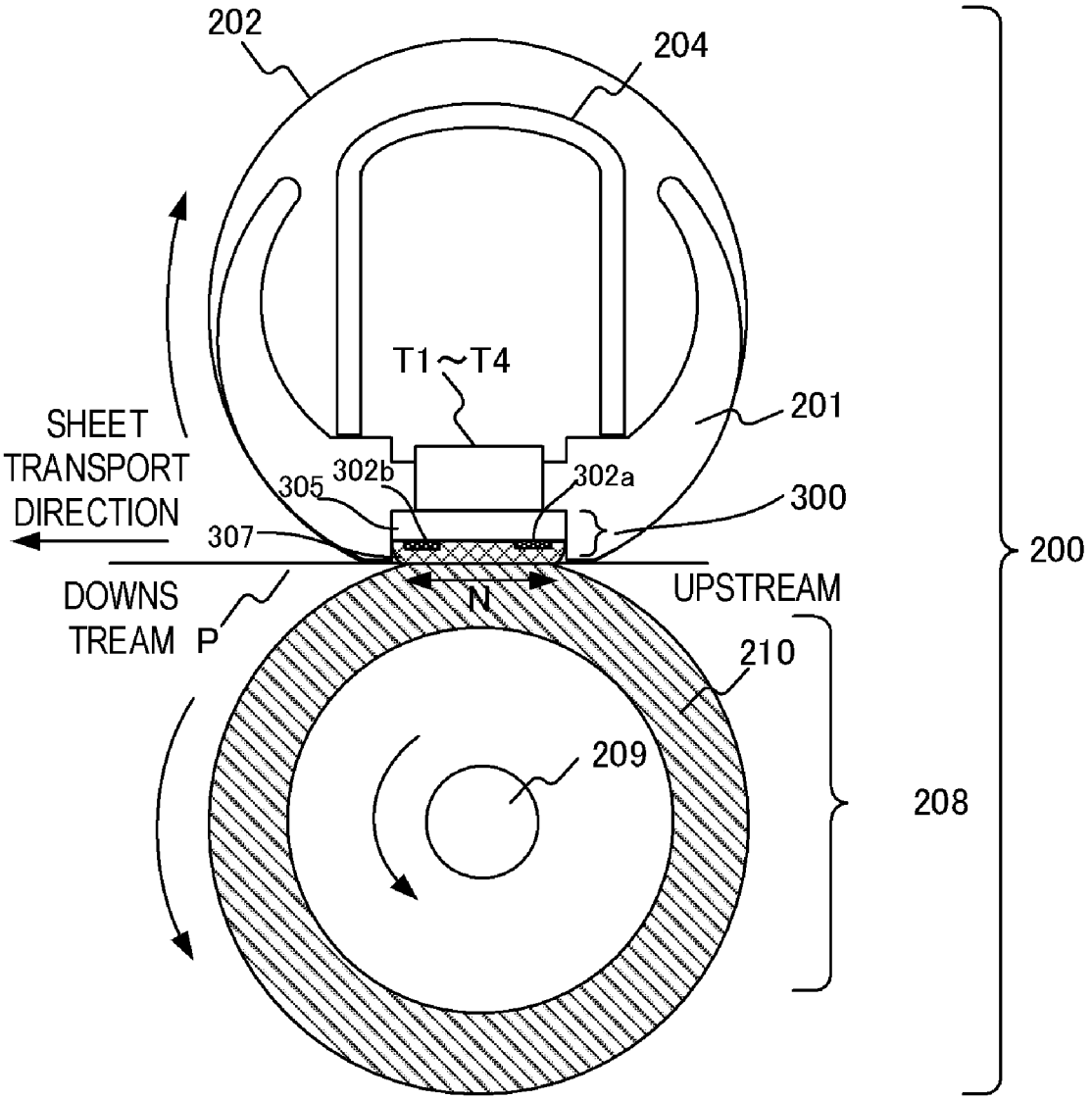
FIG. 2 is a schematic cross-sectional view of a fixing device according to Embodiments 1 and 2.

FIG. 2 is a schematic cross-sectional view of the fixing device 200 according to the present embodiment. The fixing device 200 includes a cylindrical film (an endless belt) 202, a heater 300 that makes contact with an inner surface of the film 202, and a pressure roller (a nip forming member) 208 that forms a fixing nip N together with the heater 300 with the film 202 interposed therebetween. A material of a base layer of the film 202 is a heat-resistant resin, such as polyimide, or a metal, such as stainless steel. An elastic layer, such as heat-resistant rubber, may be provided on a surface layer of the film 202. The pressure roller 208 includes a metal core 209 formed of a material, such as iron or aluminum and an elastic layer 210 formed of a material, such as silicon rubber. The heater 300 is held by a holding member 201 formed of a heat-resistant resin. The holding member 201 also has a guiding function of guiding rotation of the film 202. The pressure roller 208 rotates in a direction indicated by an arrow in response to motive power from a motor (not illustrated) serving as a driving power source. The film 202 rotates following the rotation of the pressure roller 208. The sheet P that bears a non-fixed toner image is heated while being transported in a state of being pinched at the fixing nip N, whereby the non-fixed toner image is fixed.

The heater 300 is a heater heated by a heating element 302 (302*a* and 302*b*) provided on a surface (hereafter, this surface will be defined as a front surface) of a ceramic substrate 305 on the opposite side of a side making contact with the holding member 201. Thermistors T1, T2, T3, and T4, which are temperature detection portions, are in contact with the surface of the ceramic substrate 305 of the ceramic heater 300, and, in addition to this, temperature protection elements, such as thermo-switches (not illustrated), are also in contact with the surface. The thermistors T1 to T4 are temperature detection elements and are not limited to contact-type thermistors.

In the present embodiment, the heating element 302 and the thermistors T1 to T4, as temperature detection portions, are arranged on the primary side (a primary-side circuit) of a transformer, as a first potential side, and a secondary-side (a secondary-side circuit) element, as a second potential side, is not disposed in the fixing device 200. By doing so, the need to provide a safety distance is eliminated and a size reduction is achieved.

Reference numeral 204 is a metallic stay for applying the pressure of a spring (not illustrated) to the holding member 201. In the present embodiment, although the fixing device 200 that uses a ceramic heater is described, the fixing device is not limited thereto. For example, the same advantages as Embodiment 1 are obtained in a fixing device that uses a halogen heater.

Figure 3A:
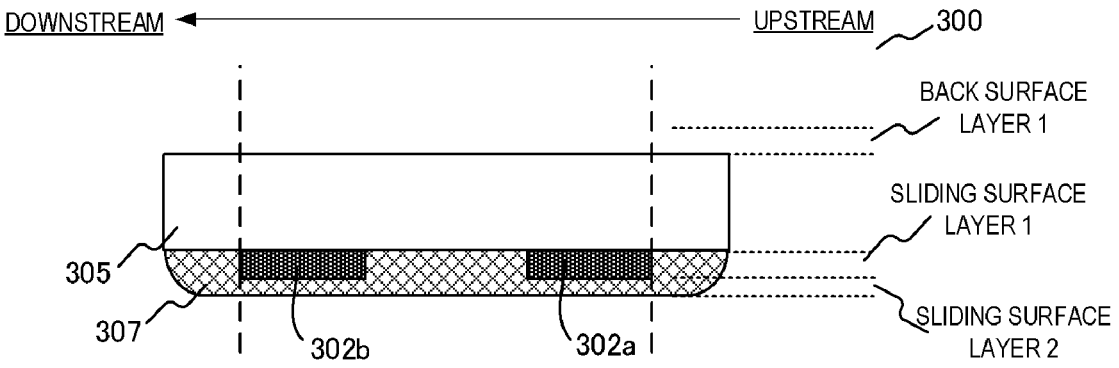
FIGS. 3A and 3B are diagrams illustrating a configuration of a heater of the fixing device according to Embodiments 1 and 2.
Figure 3B:
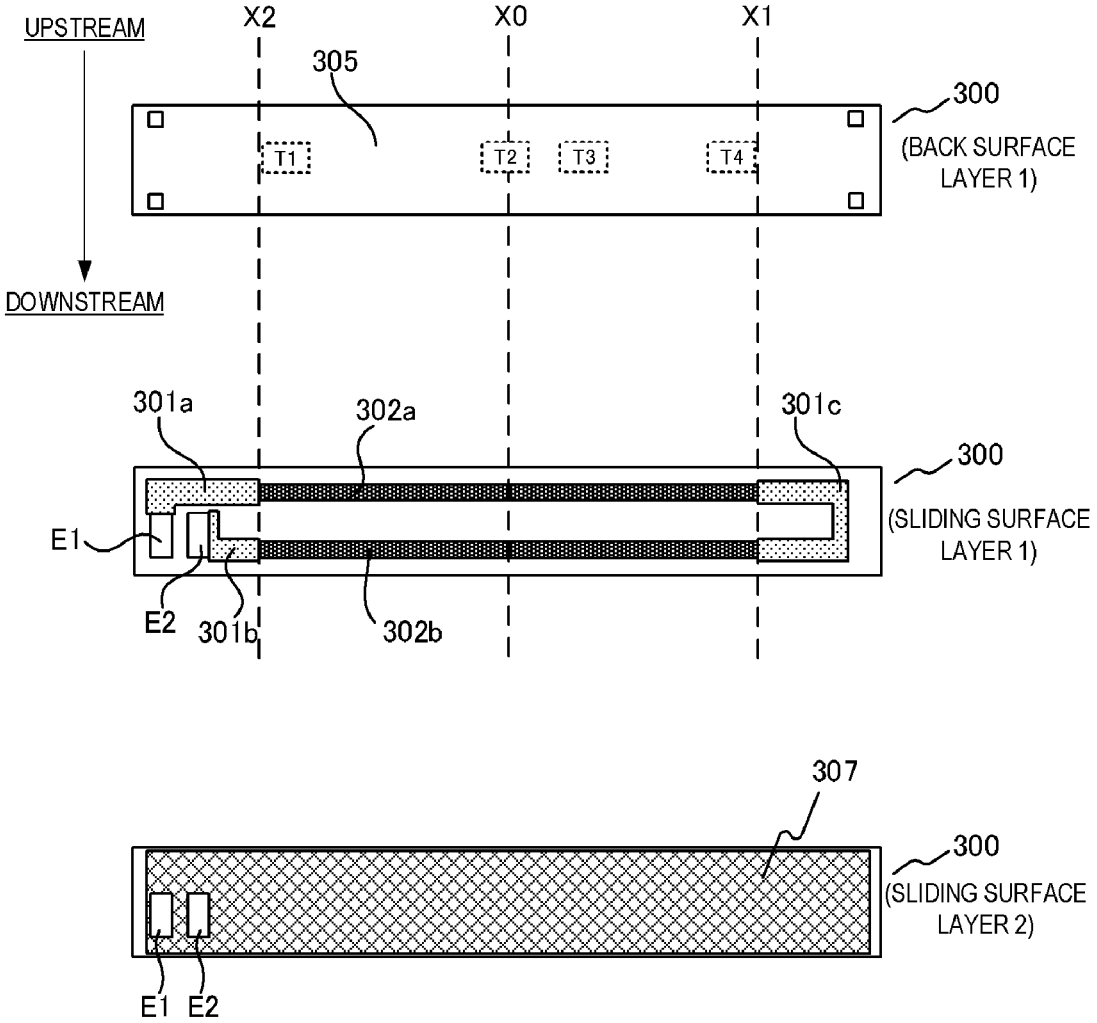

FIGS. 3A and 3B are schematic diagrams for describing a configuration of the heater 300 of Embodiment 1. FIG. 3A illustrates a schematic cross-sectional view in a lateral direction (a direction orthogonal to a longitudinal direction and a direction following a transport direction of the recording material P) of the heater 300 near X0, which is a transport reference position, illustrated in FIG. 3B. The heater 300 has heating elements 302*a* and 302*b* provided on a surface of a sliding surface layer 1, which is a first surface on the substrate 305, along the longitudinal direction of the heater 300. The heating element 302*a* is disposed on the upstream side in the transport direction of the sheet P, and a conductor 301*b* is disposed on the downstream side. A protection glass 307 covers the heating elements 302*a* and 302*b*.

FIG. 3B is a schematic plan view of the heater 300 according to Embodiment 1. The heating elements 302*a* and 302*b* on the sliding surface layer 1 are arranged in parallel along the longitudinal direction to form a heating area X1-X2. The heating elements 302*a* and 302*b* are connected to electrodes E1 and E2 via conductors 301*a*, 301*b*, and 301*c*. Electrical power is supplied to the heater 300 via the electrodes E1 and E2. The surface protection layer 307 on the sliding surface layer 2 covers areas excluding the electrodes E1 and E2, of the sliding surface layer 1. T1, T2, T3, and T4, indicated by dot-lined frames, indicate the thermistors T1 to T4 illustrated in FIG. 2. In order to detect the temperature of the heater 300, the thermistors T1 to T4, formed of a material (in the present embodiment, an NTC material) having high positive temperature coefficient of resistance characteristics (PTC) or negative temperature coefficient of resistance characteristics (NTC) are in contact with the heater 300. The thermistors T1 and T4 are positioned at both ends in the longitudinal direction of the heating area X1-X2, the thermistor T2 is positioned near the center in the longitudinal direction of the heater 300, and the thermistor T3 is positioned at a position corresponding to an end during transport of a small-size sheet.

Figure 4A:
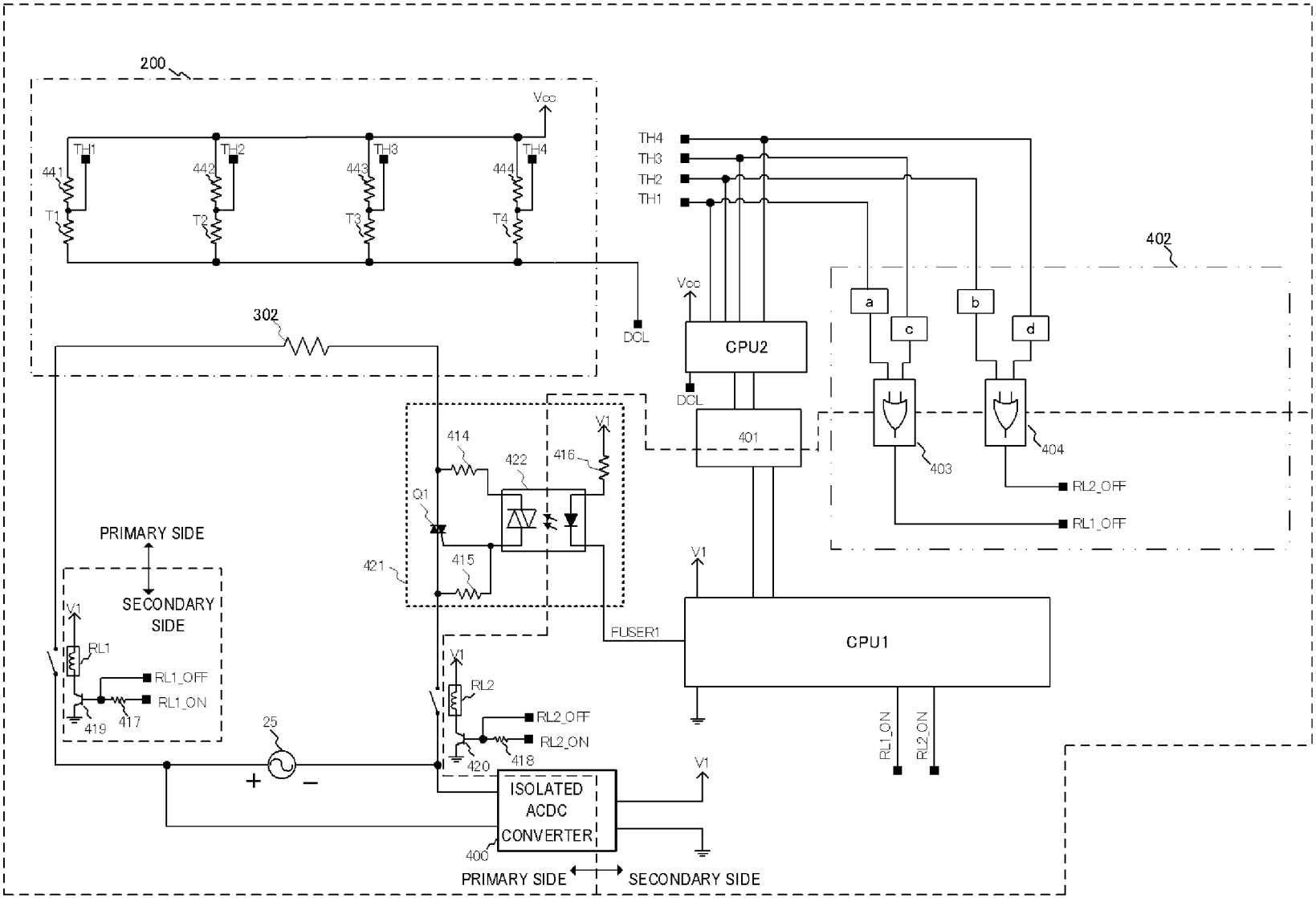
FIG. 4A is a diagram of an electrical power supply circuit that supplies electrical power to the fixing device according to Embodiment 1.

FIG. 4A illustrates a circuit diagram of an electrical power supply circuit that supplies electrical power to the fixing device 200 according to Embodiment 1. The electrical power supply circuit is a circuit that supplies electrical power from an alternating current (AC) power supply 25 to the heating element 302 inside the fixing device 200 and controls temperature so that a predetermined temperature is maintained. An isolated alternating current/direct current (AC/DC) converter 400 is a switching power supply circuit that supplies a stable voltage V1 from the AC power supply 25 to the secondary-side circuit. The voltage V1 is supplied to a central processing unit (CPU) 1, and the CPU 1, as a control unit disposed on the secondary side, controls an image forming process and a driving element (not illustrated) of the laser printer 10 and the temperature of the fixing device 200. A CPU 2 is disposed on the primary side to monitor the temperature of the thermistor and transmits the temperature information to the CPU 1. The CPU 1 and the CPU 2 perform isolated communication via an isolated communication unit 401.

A protection circuit block 402 is a circuit that operates so that the supply of electrical power to the heating element 302 is stopped on the basis of signals TH1 to TH4. The heating element 302 generates heat when electrical power is supplied from the AC power supply 25 connected to the laser printer 10 to the heating element 302 inside the heater 300 via a relay RL1, a relay RL2, and a triac Q1.

Next, an operation of the relay RL1 will be described. Reference numerals 417 and 418 indicate resistors, and reference numeral 420 indicates negative-positive-negative (NPN) transistor. The relay RL1 is controlled according to a signal RL1_ON output from the CPU 1. When the signal RL1_ON changes to the High state, the relay-driving NPN transistor 419 enters into the ON state, and the relay RL1 enters into the ON state. When the signal RL1_ON changes to the Low state, the NPN transistor 419 enters into the OFF state, and the relay RL1 enters into the OFF state. The relay RL2 operates according to a signal RL2 ON output from the CPU 1. The detailed operation is similar to that of the relay RL1, and the description thereof will be omitted.

Next, a triac driving circuit 421 as a driving unit will be described. Reference numerals 414 to 416 indicate resistors, reference numeral 422 indicates a phototriac coupler, and reference numeral Q1 indicates a triac. The electrical power supplied to the heating element 302 is controlled by energization/interruption of the triac Q1. The triac Q1 is controlled according to a signal FUSER1 output from the CPU 1, and a primary circuit (a primary-side circuit) and a secondary circuit (a secondary-side circuit) are reinforced insulated (reinforced insulation includes double insulation) by the phototriac coupler 422. When the signal FUSER1 changes to the Low state, current flows into a secondary-side diode of the phototriac coupler 422 and a primary-side triac of the phototriac coupler 422 operates. A trigger current flows into a gate electrode of the triac Q1 via the resistor 414 or the resistor 415, and the triac Q1 enters into the ON state.

Next, temperature detection by the thermistors T1 to T4 will be described. Vcc indicates a stable voltage based on a DC reactor (DCL). The temperature detected by the thermistor T1 is detected by the CPU 2 as a signal TH1, which is a voltage obtained by dividing the voltage Vcc by the resistor 441 and the thermistor T1. Moreover, the temperature detected by the thermistor T2 is detected by the CPU 2 as a signal TH2, which is a voltage obtained by dividing the voltage Vcc by the resistor 442 and the thermistor T2. Similarly, the temperature detected by the thermistor T3 is detected by the CPU 2 as a signal TH3, which is a voltage obtained by dividing the voltage Vcc by the resistor 443 and the thermistor T3, and the temperature detected by the thermistor T4 is detected by the CPU 2 as a signal TH4, which is a voltage obtained by dividing the voltage Vcc by the resistor 444 and the thermistor T4.

Figure 4B:
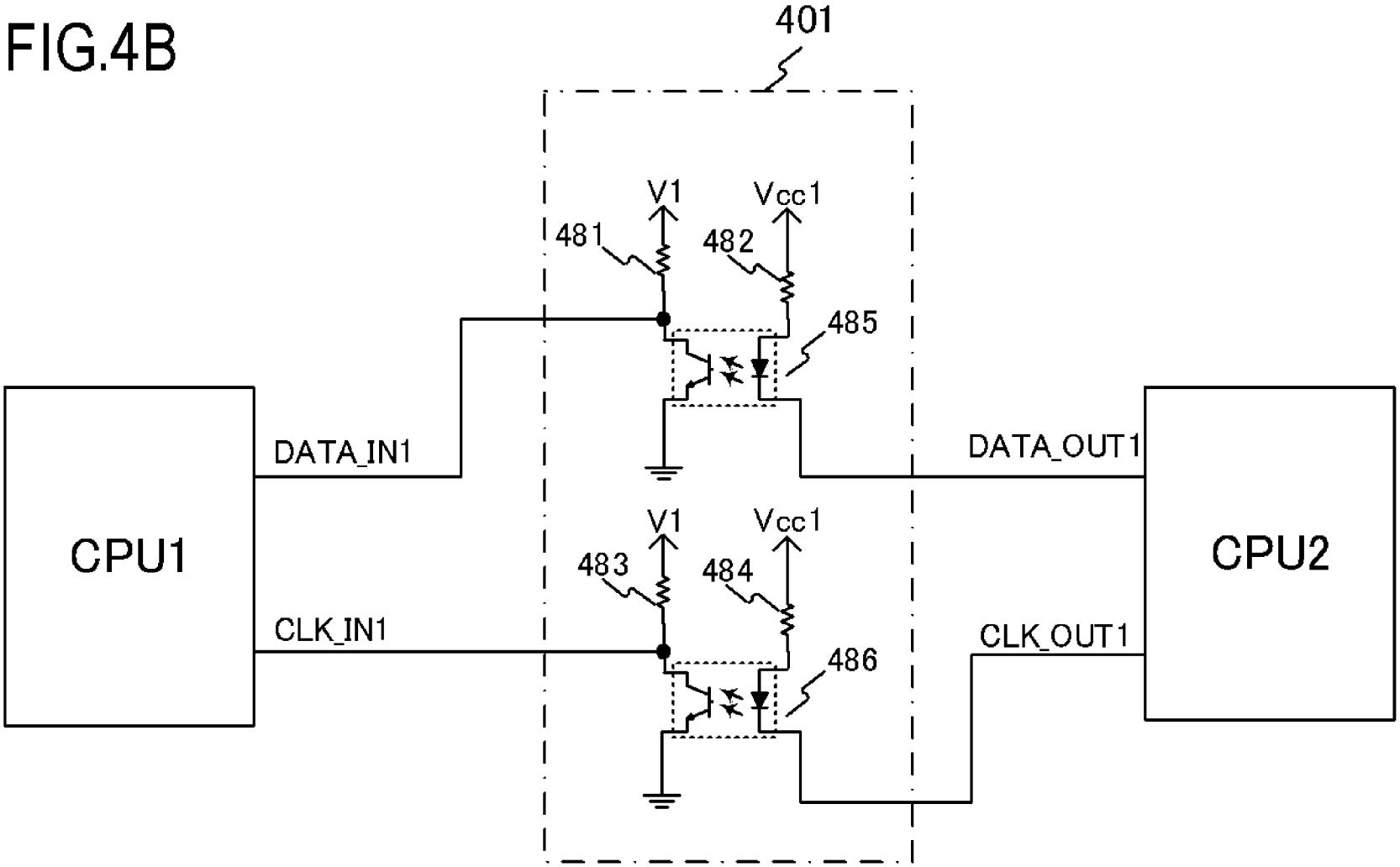
FIG. 4B is a diagram of an electrical power supply circuit that supplies electrical power to the fixing device according to Embodiment 1.

FIG. 4B illustrates an example of an isolated communication portion between the CPU 1 and the CPU 2 in FIG. 4A. The isolated communication unit 401 includes resistors 481 to 484, a photocoupler 485, and a photocoupler 486. The temperature detected by the CPU 2 is output as signals CLK_OUT1 and DATA_OUT1, which are transmitted to the secondary-side CPU 1 as signals CLK_IN1 and DATA_IN1, respectively. Signals CLK_OUT1, DATA_OUT1, CLK_IN1, and DATA_IN1 are reinforced-insulated by the photocouplers 485 and 486. Although a two-wire unidirectional communication scheme is illustrated in FIG. 4B, other communication schemes and bidirectional communication schemes may be used. For example, an inter-integrated circuit (I2C) may be used. Alternatively, a universal asynchronous receiver transmitter (UART), a serial peripheral interface (SPI), and the like, may be used. In this manner, the temperature information of the heater 300 detected by the thermistors T1 to T4 is transmitted from the CPU 2 to the CPU 1, and the CPU 1 controls the electrical power supplied from the AC power supply 25 to the heating element 302 on the basis of the temperature information. In internal processing of the CPU 1, electrical power to be supplied is calculated by proportional-integral (PI) control, for example, on the basis of the setting temperature of the heater 300 and the temperature information of the thermistors. Furthermore, the electrical power to be supplied is converted to a control level of a phase angle (phase control) or a wave-number (wave-number control), and the triac Q1 is controlled according to the control condition.

Figure 4C:
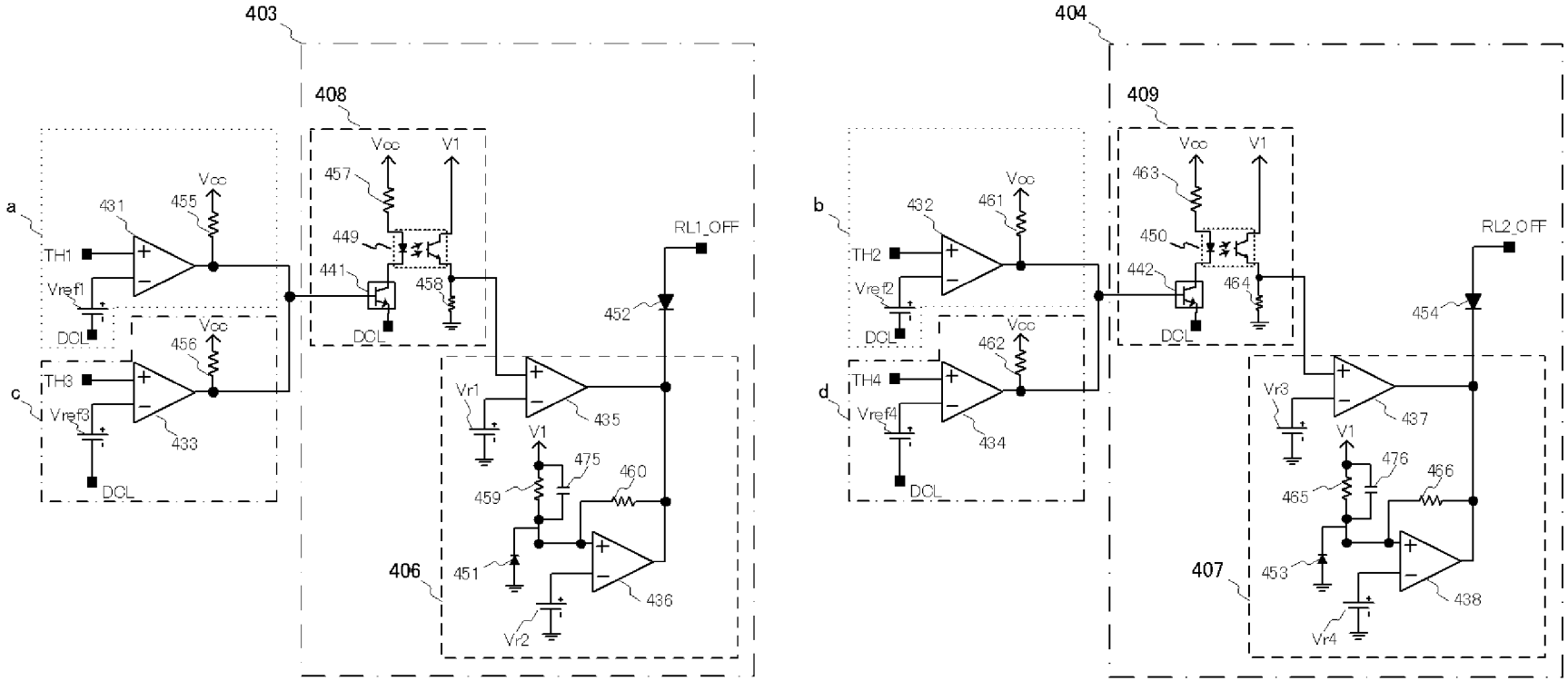
FIG. 4C is a diagram of an electrical power supply circuit that supplies electrical power to the fixing device according to Embodiment 1.

FIG. 4C illustrates an example of the protection circuit block 402 in FIG. 4A. The protection circuit block 402 includes abnormality detection portions a to d as an abnormality detection circuit portion, a protection circuit 403, and a protection circuit 404. The protection circuit 403 is connected to the abnormality detection portion a and the abnormality detection portion c and includes abnormality transmission portion 408 as an abnormality transmission circuit portion and a latch circuit 406. The protection circuit 404 is connected to the abnormality detection portion b and the abnormality detection portion d and includes abnormality transmission portion 409 as an abnormality transmission circuit portion and a latch circuit 407.

The abnormality detection portions a to d are circuits that operate on the basis of the voltages of the signals TH1 to TH4 that change according to the temperature of the thermistors T1 to T4. In the drawing, reference numerals Vref1 to Vref4 are predetermined abnormality voltage thresholds, reference numerals Vr1 to Vr4 are latching thresholds of the latch circuits 406 and 407, and reference numerals 431 to 438 are open-collector comparators. Moreover, reference numerals 441 and 442 are NPN transistors, reference numerals 449 and 450 are photocouplers, reference numerals 451 to 454 are diodes, reference numerals 455 to 466 are resistors, and reference numerals 475 and 476 are capacitors.

Next, an operation of the protection circuit 403 in a normal state will be described. Since the thermistor T1 in FIG. 4A has NTC characteristics, when the temperature of the thermistor T1 is low, the resistance value of the thermistor T1 increases and the voltage level of the signal TH1 increases. Since the voltage level of the signal TH1 is sufficiently greater than a predetermined abnormality voltage threshold Vref1 when the supply of electrical power to the heating element 302 and the temperature control of the CPU 1 are performed normally, the output of the comparator 431 enters into an open-collector state. Therefore, since the base terminal of the NPN transistor 441 changes to the High state, the NPN transistor 441 enters into the ON state. Since a current flows into an emission side of the photocoupler 449 via the resistor 457, a reception-side transistor also enters into the ON state and the positive (+) terminal of the comparator 435 changes to the High state. Since the voltage of the positive (+) terminal of the comparator 435 is greater than the predetermined latching threshold Vr1, the output of the comparator 435 changes to an open-collector state.

Since the voltage V1 is sufficiently greater than the predetermined latching threshold Vr2 of the comparator 436 of the latch circuit 406, the voltage of the positive (+) terminal of the comparator 436 becomes greater than the voltage of the negative (−) terminal and the output of the comparator 436 changes to an open-collector state. Therefore, the diode 452 enters into the OFF state and the signal RL1_OFF does not put the NPN transistor 419 into the OFF state.

Next, an operation of the protection circuit 403 when the heating element 302 generates heat abnormally will be described. Since the thermistor T1 in FIG. 4A has NTC characteristics, when the temperature of the thermistor T1 increases, the resistance of the thermistor T1 decreases and the voltage level of the signal TH1 decreases. Since the voltage level of the signal TH1 becomes less than the predetermined abnormality voltage threshold Vref1 when the supply of electrical power to the heating element 302 and the temperature control of the CPU 1 are not performed normally and the heating element 302 generates heat abnormally, the output of the comparator 431 changes to the Low state. Therefore, the base terminal of the NPN transistor 441 changes to the Low state, and the NPN transistor 441 enters into the OFF state. Since a current does not flow into an emission side of the photocoupler 449, a reception-side transistor also enters into the OFF state and the positive (+) terminal of the comparator 435 changes to the Low state. Since the voltage of the positive (+) terminal of the comparator 435 is less than the predetermined abnormality voltage threshold Vr1, the output of the comparator changes to the Low state, and the signal RL1_OFF is changed to the Low state via the diode 452. As illustrated in FIG. 4A, when the signal RL1_OFF changes to the Low state, the NPN transistor 419 for driving the relay RL1 enters into the OFF state regardless of the signal RL1_ON and the relay RL1 also enters into the OFF state. Therefore, it is possible to stop the supply of electrical power from the AC power supply 25 to the heating element 302.

When the output of the comparator 435 changes to the Low state, the voltage of the positive (+) terminal of the comparator 436 also changes to the Low state via the resistor 460. Since the voltage of the positive (+) terminal of the comparator 436 is less than the predetermined latching threshold Vr2 of the comparator 436 of the latch circuit 406, the output of the comparator 436 changes to the Low state. In this way, it is possible to maintain the stopped state of the supply of electrical power to the heating element 302 until the power (not illustrated) of the comparator 436 is reset.

Since the operations of the abnormality detection portions b, c, and d are similar to that of the abnormality detection portion a, the description thereof will be omitted. Moreover, the protection circuit 404 independent from the protection circuit 403 is provided in order to secure the function of protection portion when hardware represented by the protection circuit 403 or the NPN transistor 419 fails. Since the operation of the protection circuit 404 is similar to that of the protection circuit 403, the description thereof will be omitted.

The protection circuit block 402 may stop the supply of electrical power to the heating element 302 upon detecting an abnormality in any one of the thermistors T1 to T4. Therefore, it is not necessary to specify an abnormal thermistor. Therefore, as illustrated in FIGS. 4A and 4C, by OR-connecting the abnormality detection portion a and the abnormality detection portion c to the abnormality transmission portion 408, the supply of electrical power to the heating element 302 can be stopped when any one of the abnormality detection portions detects an abnormality.

As described above, by OR-connecting the output of the abnormality detection circuit to the abnormality transmission portion, it is possible to secure the function of necessary protection portion without increasing the number of abnormality transmission portions and latch circuits to correspond to the number of thermistors.

Embodiment 2

Embodiment 2 of the present invention will be described. In Embodiment 2, a CPU 3 that controls driving of the laser printer 10 and performs an image forming process, the thermistors T1 to T4 are disposed on the secondary side, and a CPU 4 that controls the supply of electrical power to the heating element 302 on the basis of the temperature information of the thermistors T1 to T4 is disposed on the primary side. Components similar to those of Embodiment 1 among components of Embodiment 2 will be denoted by the same reference numerals, and the description thereof will be omitted. In Embodiment 2, matters that are not described particularly herein are similar to those of Embodiment 1.

In the configuration of the present embodiment, switching elements (RL1, RL2, and Q1) that perform and interrupt the supply of electrical power to the heating element 302 and the temperature-control CPU 4 are disposed on the primary side. By doing so, since it is not necessary to realize double insulation using switching elements, it is possible to realize a size reduction of an apparatus with a lower cost than Embodiment 1. In such a configuration, the output of abnormality detection portions e to h based on the temperature information of a plurality of thermistors T1 to T4 that detect the temperature of the heating element 302 are OR-connected to an abnormality transmission portion 508 or an abnormality transmission portion 509. By doing so, when any one of the abnormality detection portions e to h detects an abnormality, the supply of electrical power to the heating element 302 can be stopped.

Next, Embodiment 2, in which the heater 300 is mounted on the laser printer 10, will be described. Since the cross-sectional view of the fixing device 200 and the cross-sectional view of the heater 300 are similar to those of Embodiment 1, the description thereof will be omitted. The present embodiment is different from Embodiment 1 in that the thermistors T1 to T4 are disposed on the secondary side. Moreover, in the present embodiment, the heating elements 302*a* and 302*b* are covered by the substrate 305 and the surface protection layer 307 on the front surface side of the heater 300, whereby double insulation between the heating elements 302*a* and 302*b* on the primary side of the AC power supply 25 and the film 202 and the thermistors T1 to T4 is realized. As means for realizing double insulation, a method of realizing double insulation using an insulation member between the thermistors T1 to T4 and the heater 300 may be used.

Figure 5A:
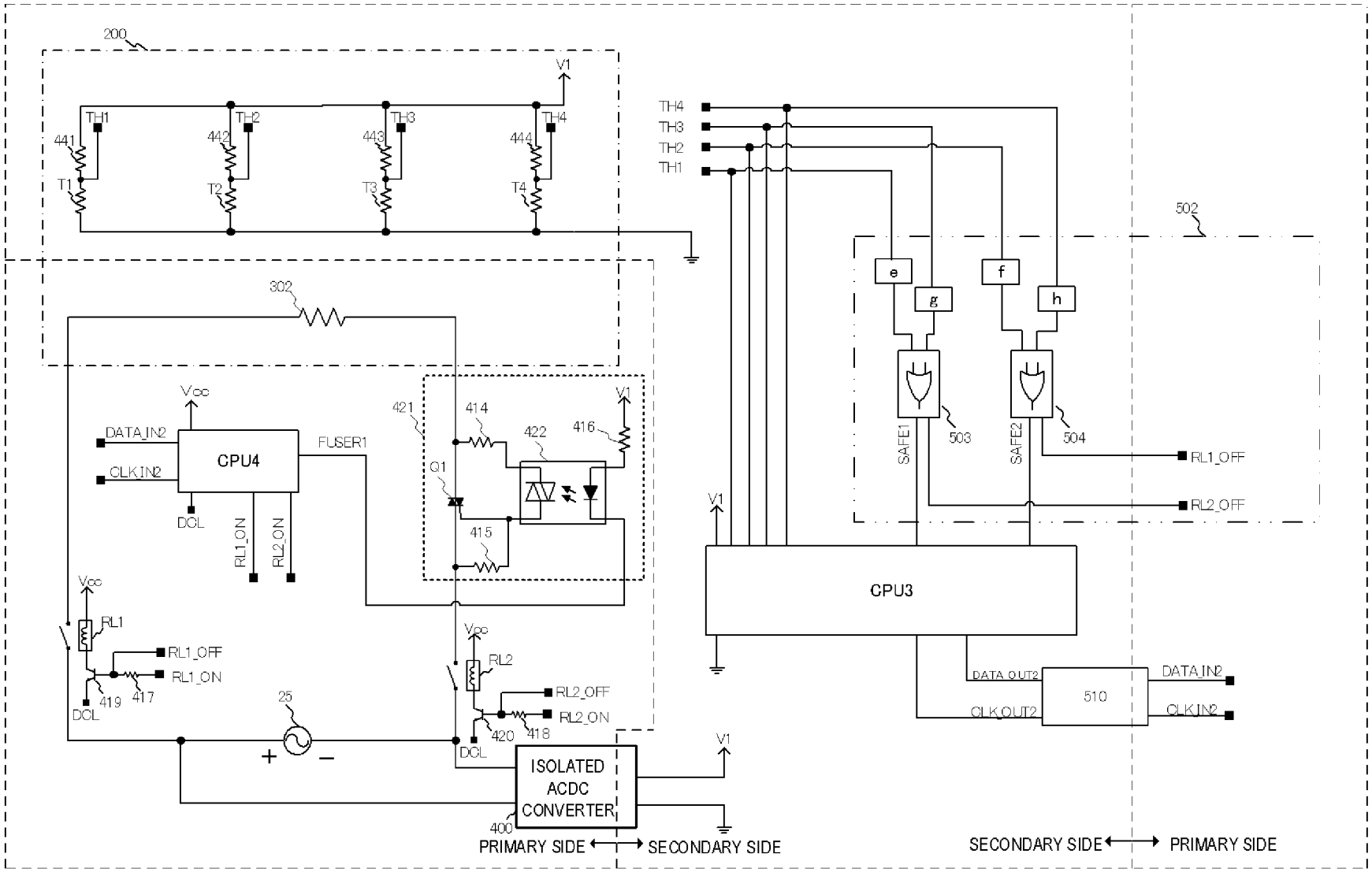
FIG. 5A is a diagram of an electrical power supply circuit that supplies electrical power to the fixing device according to Embodiment 2.

FIG. 5A illustrates a circuit diagram of an electrical power supply circuit that supplies electrical power to the fixing device 200 according to Embodiment 2. The electrical power supply circuit is a circuit that supplies electrical power from the AC power supply 25 to the heating element 302 inside the fixing device 200 and controls the temperature so that a predetermined temperature is maintained. A secondary-side voltage V1 is supplied to the CPU 3, and the CPU 3, disposed on the secondary side, controls an image forming process and driving of a driving element (not illustrated) of the laser printer 10. Moreover, the CPU 3 monitors the temperature of the thermistors T1 to T4 on the basis of the signals TH1 to TH4. The CPU 4 is disposed on the primary side to control the electrical power supplied to the switching elements (RL1, RL2, and Q1) on the basis of the temperature information of the thermistor acquired by the isolated communication unit 510 from the CPU 3. The protection circuit block 502 is a circuit that stops the supply of electrical power to the heating element 302 on the basis of the signals TH1 to TH4.

The heating element 602 generates heat when electrical power is supplied from the AC power supply 25, connected to the laser printer 10, to the heating element 302 inside the heater 300 via the relays RL1 and RL2 and the triac Q1. Since the operations of the relays RL1 and RL2 and the triac Q1 are similar to those of Embodiment 1, the description thereof will be omitted.

In the present embodiment, since the relay RL1, which is an element that performs/interrupts the supply of electrical power to the heating element 302, and the CPU 4 that controls the relay RL1 are disposed on the primary side, it is not necessary to realize double insulation between the relay RL1 and the CPU 4. Therefore, an element for turning ON/OFF the heating element 302 is not limited to a relay, but energization/de-energization may be achieved by switching elements, such as semiconductors. Similarly, double insulation may not be realized for the relay RL2 and the triac Q1. In this manner, in the present embodiment, a circuit may be configured by replacing a switching element for controlling the supply of electrical power to the heating element 302 with inexpensive semiconductors.

Next, detection of temperature by the thermistors T1 to T4 will be described. The temperature detected by the thermistor T1 is detected by the CPU 3 as a signal TH1, which is a voltage obtained by dividing the voltage V1 by the resistor 441 and the thermistor T1. The temperature detected by the thermistor T2 is detected by the CPU 3 as a signal TH2, which is a voltage obtained by dividing the voltage V1 by the resistor 442 and the thermistor T2. Similarly, the temperature detected by the thermistor T3 is detected by the CPU 3 as a signal TH3, which is a voltage obtained by dividing the voltage V1 by the resistor 443 and the thermistor T3, and the temperature detected by the thermistor T4 is detected by the CPU 3 as a signal TH4, which is a voltage obtained by dividing the voltage V1 by the resistor 444 and the thermistor T4.

Figure 5B:
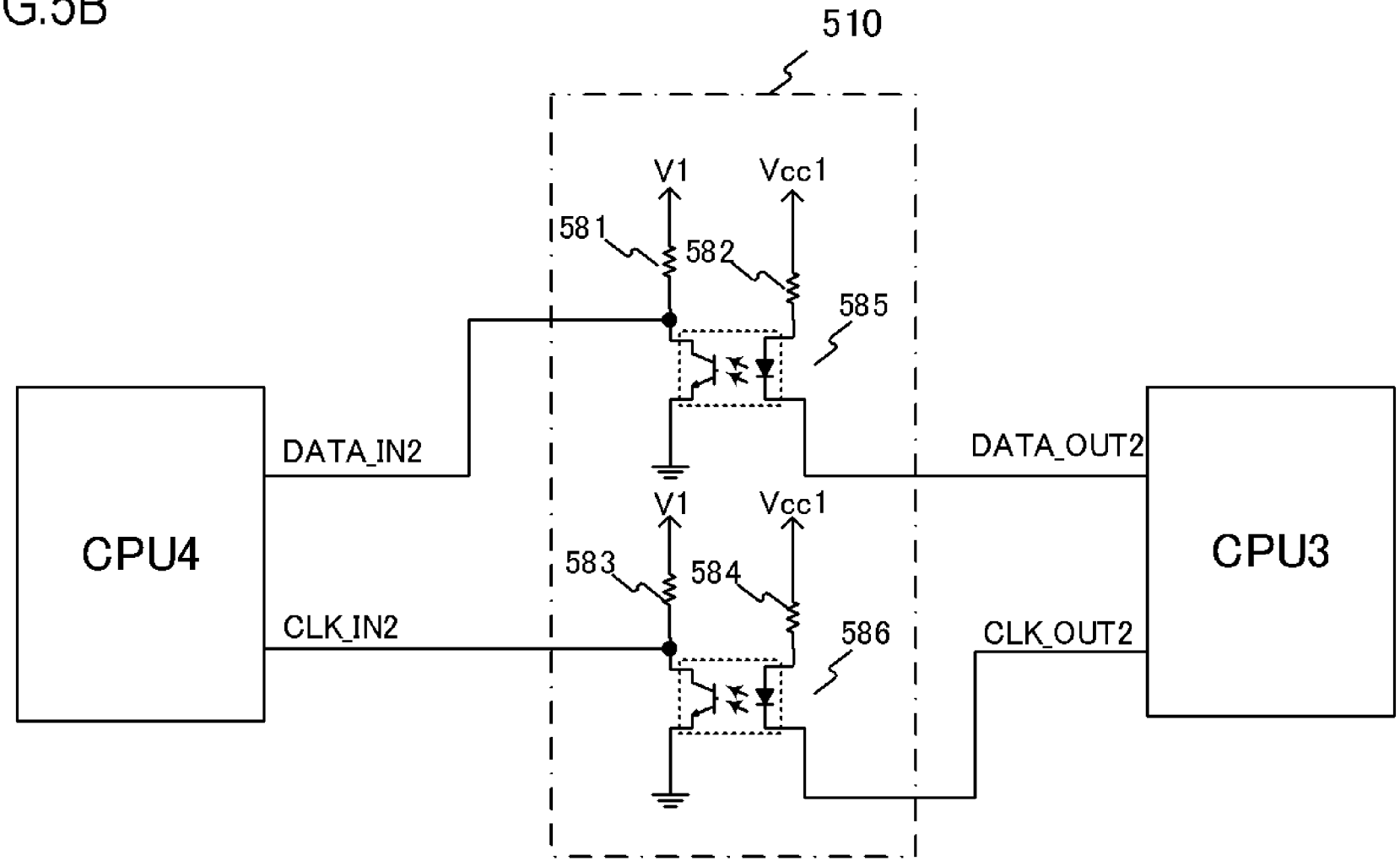
FIG. 5B is a diagram of an electrical power supply circuit that supplies electrical power to the fixing device according to Embodiment 2.

FIG. 5B illustrates an example of the isolated communication unit 510 in FIG. 5A. The isolated communication unit 510 includes resistors 581 to 584, a photocoupler 585, and a photocoupler 586. The temperature detected by the CPU 3 is output as a signal CLK_OUT2 and a signal DATA_OUT2, which are transmitted to the primary-side CPU 4 as a signal CLK_IN2 and a signal DATA_IN2, respectively. The signals CLK_OUT2, DATA_OUT2, CLK_IN2, and DATA_IN2 are reinforced-insulated by the photocouplers 585 and 586.

In this manner, the temperature information of the heater 300 detected by the thermistors T1 to T4 is transmitted from the CPU 3 to the CPU 4, and the CPU 4 controls the electrical power supplied from the AC power supply 25 to the heater 300 on the basis of the temperature information of the heater 300. In internal processing of the CPU 1, electrical power to be supplied is calculated by PI control, for example, on the basis of the setting temperature of the heater 300 and the temperature detected by the thermistors. Furthermore, the electrical power to be supplied is converted to a control level of a phase angle (phase control) or a wave-number (wave-number control), and the triac Q1 is controlled according to the control condition.

Figure 5C:
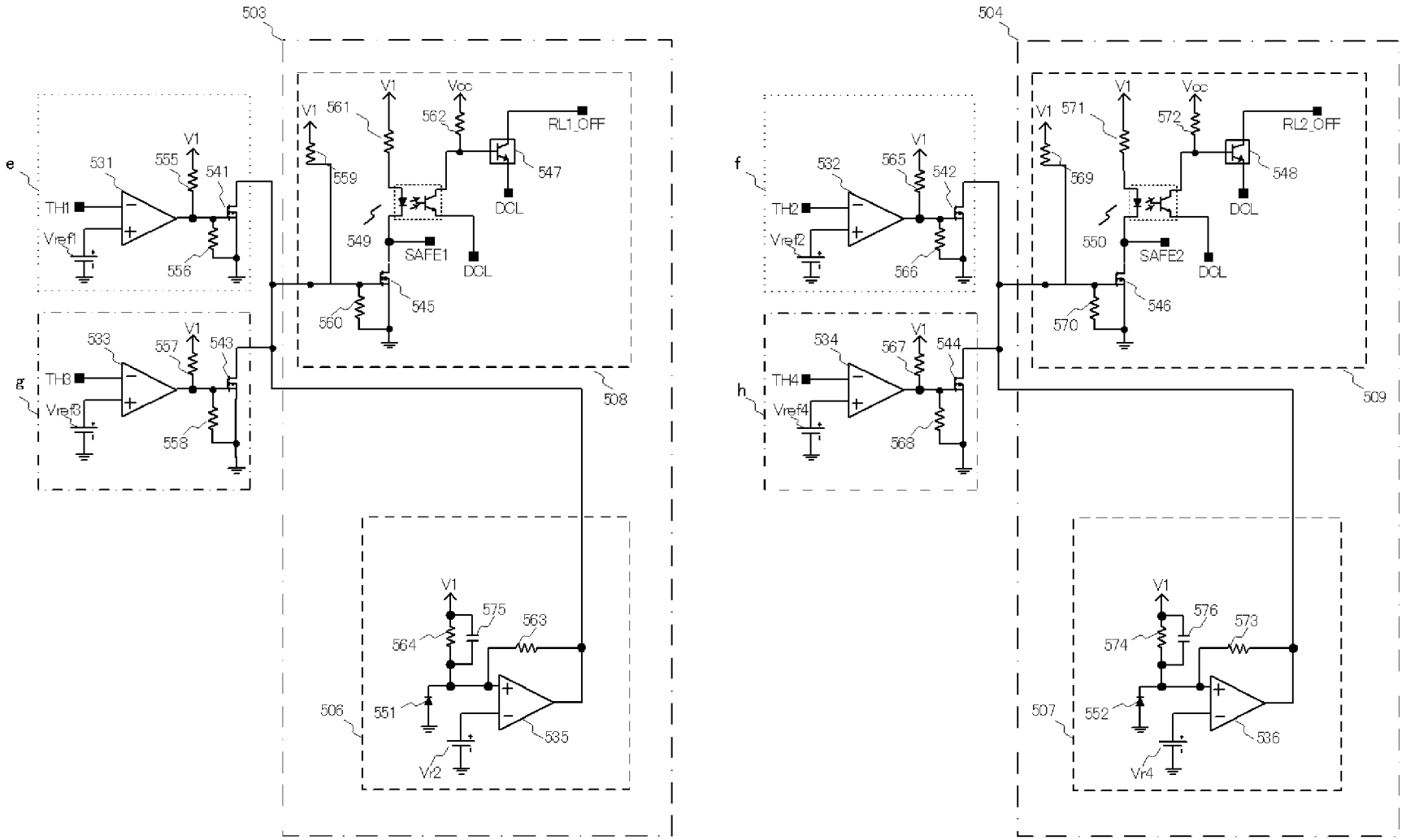
FIG. 5C is a diagram of an electrical power supply circuit that supplies electrical power to the fixing device according to Embodiment 2.

FIG. 5C illustrates an example of the protection circuit block 502 in FIG. 5A. The protection circuit block 502 includes abnormality detection portions e to h, a protection circuit 503, and a protection circuit 504. The protection circuit 503 is connected to the abnormality detection portion e and the abnormality detection portion g, and includes an abnormality transmission portion 508 and a latch circuit 506. The protection circuit 504 is connected to the abnormality detection portion f and the abnormality detection portion h, and includes an abnormality transmission portion 509 and a latch circuit 507. The abnormality detection portions e to h are circuits that operate on the basis of the voltages of the signals TH1 to TH4 that change according to the temperature of the thermistor T1 to T4. In the drawing, reference numerals 531 to 536 are open-collector comparators, reference numerals 541 to 546 are N-channel metal-oxide-semiconductor field-effect transistors (MOSFETs), and reference numerals 547 and 548 are NPN transistors. Moreover, reference numerals 549 and 550 are photocouplers, reference numerals 551 and 552 are diodes, reference numerals 555 to 574 are resistors, and reference numerals 575 and 576 are capacitors.

Next, an operation of the protection circuit 503 in a normal state will be described. Since the thermistor T1 in FIG. 5A has NTC characteristics, when the temperature of the thermistor T1 is low, the resistance value of the thermistor T1 increases and the voltage level of the signal TH1 increases. Since the voltage level of the signal TH1 is sufficiently greater than a predetermined abnormality voltage threshold Vref1 when the supply of electrical power to the heating element 302 and the temperature control of the CPU 3 and the CPU 4 are performed normally, the output of the comparator 531 changes to the Low state. Therefore, since the gate terminal of the MOSFET 541 changes to the Low state, the MOSFET 541 enters into the OFF state. Since the MOSFET 545 enters into the ON state and a voltage is supplied to the emission side of the photocoupler 549, a reception-side transistor also enters into the ON state and a current flows to a reception side via the resistor 558. Since a base-emitter voltage of the NPN transistor 547 changes to the Low state, the NPN transistor 547 enters into the OFF state.

Since the voltage V1 is sufficiently greater than the latching threshold Vr2 of the comparator 535 of the latch circuit 506, the voltage of the positive (+) terminal of the comparator 535 becomes greater than the voltage of the negative (−) terminal, and the output of the comparator 535 changes to an open-collector state. Therefore, the signal RL1_OFF does not put the NPN transistor 419 into the OFF state.

Since a signal SAFE1 is input to the CPU 3, the CPU 3 can detect whether the abnormality detection portion e or g operates normally. When the abnormality detection portion operates normally, the CPU 3 detects the signal SAFE1 as the Low signal. Similarly, a signal SAFE2 enables whether the abnormality detection portion for h operates normally to be detected.

Next, an operation of the protection circuit 503 when the heating element 302 generates heat abnormally will be described. Since the thermistor T1 in FIG. 5A has NTC characteristics, when the temperature of the thermistor T1 increases, the resistance of the thermistor T1 decreases and the voltage level of the signal TH1 decreases. As illustrated in FIG. 5C, the voltage level of the signal TH1 becomes less than the predetermined abnormality voltage threshold Vref1 when the supply of electrical power to the heating element 302 and the temperature control of the CPU 3 and the CPU 4 are not performed normally and the heating element 302 generates heat abnormally. Therefore, the output of the comparator 531 changes to an open-collector state. Therefore, since a current flows into the gate terminal of the MOSFET 541 via the resistor 555, the MOSFET 541 enters into the ON state. Since the drain voltage of the MOSFET 541 changes to the Low state, the MOSFET 545 enters into the OFF state. Since a voltage is not supplied to the emission side of the photocoupler 549, a reception-side transistor enters into the OFF state. Since the base voltage of the NPN transistor 547 changes to the High state, the NPN transistor 547 enters into the ON state and the signal RL1_OFF changes to the Low state. As illustrated in FIG. 5A, when the signal RL1_OFF changes to the Low state, the NPN transistor 419 for driving the relay RL1 enters into the OFF state regardless of the signal RL1_ON and the relay RL1 also enters into the OFF state. Therefore, it is possible to stop the supply of electrical power from the AC power supply 25 to the heating element 302.

When the MOSFET 541 enters into the ON state, the voltage of the positive (+) terminal of the comparator 535 changes to the Low state via the resistor 563. Since the voltage of the positive (+) terminal of the comparator 535 is less than the predetermined latching threshold Vr2 of the comparator 535 of the latch circuit 506, the output of the comparator 535 changes to the Low state. In this way, it is possible to maintain the stopped state of the supply of electrical power to the heating element 302 until the power (not illustrated) of the comparator 535 is reset.

Since the operations of the abnormality detection portions f, g, and h are similar to that of the abnormality detection portion e, the description thereof will be omitted. Moreover, the protection circuit 504 independent from the protection circuit 503 is provided in order to secure the function of protection portion when hardware represented by the protection circuit 503 or the NPN transistor 419 fails. Since the operation of the protection circuit 504 is similar to that of the protection circuit 503, the description thereof will be omitted.

The protection circuit block 502 may stop the supply of electrical power to the heating element 302 upon detecting an abnormality in any one of the thermistors T1 to T4. Therefore, it is not necessary to specify an abnormal thermistor. Therefore, as illustrated in FIGS. 5A and 5C, by OR-connecting the abnormality detection portion e and the abnormality detection portion g to the abnormality transmission portion 508, the supply of electrical power to the heating element 302 can be stopped when any one of the abnormality detection portions detects an abnormality.

As described above, in the present embodiment, the thermistor and the abnormality detection portions are disposed on the secondary side, and electrical power control portion is disposed on the primary side. In such a configuration, by OR-connecting the output of the abnormality detection portions to the abnormality transmission portion, it is possible to secure the function of a necessary protection portion without increasing the number of abnormality transmission portions and latch circuits to correspond to the number of thermistors.

Embodiment 3

In Embodiment 3 of the present invention, a CPU 5 that controls an image forming process and driving of the laser printer 10, and controls the temperature of a heating element 702, is disposed on the secondary side, and a switching element is disposed on the primary side. Furthermore, thermistors T11, T21, T31, T41, T51, T61, and T71, thermistors T12, T22, T32, T42, T52, T62, and T72, and a CPU 6 that communicates the temperature information of the thermistors with the CPU 5 are disposed on an intermediate potential side insulated from both the primary side and the secondary side. This is a characteristic configuration of the present embodiment. Components similar to those of the above-described embodiments among components of Embodiment 3 will be denoted by the same reference numerals, and the description thereof will be omitted. In Embodiment 3, matters that are not described particularly herein are similar to those of the above-described embodiments.

In a configuration of the present embodiment, the thermistors T11 to T71 and the thermistors T12 to T72 are insulated from both a primary circuit and a secondary circuit by a thin a surface protection layer. In this way, it is possible to enhance thermo-responsiveness of the heater 700. In such a configuration, the output of abnormality detection portions 1*a* to 1*f* and abnormality detection portions 2*a* to 2*g* is based on the temperature information of the plurality of thermistors T11 to T71 and thermistors T12 to T72 that detect the temperature of the heating element 702 that is OR-connected to abnormality transmission portion 808 or abnormality transmission portion 809. By doing so, when any one of the abnormality detection portions operates, the supply of electrical power to the heating element 702 can be stopped.

Next, Embodiment 3, in which a fixing device 600 and the heater 700 are mounted on the laser printer 10, will be described. Components similar to those of Embodiments 1 and 2 will be denoted by the same reference numerals, and the description thereof will be omitted. The laser printer 10 of the present embodiment supports a plurality of recording material sizes. Letter sheets (approximately 216 mm×279 mm), Legal sheets (approximately 216 mm×356 mm), and A4 sheets (210 mm×297 mm) can be set on the sheet feeding cassette 11. Furthermore, Executive sheets (approximately 184 mm×267 mm), Japanese Industrial Standard (JIS) B5 sheets (182 mm×257 mm), and A5 sheets (148 mm×210 mm) can be set. The apparatus of this example is a laser printer that basically feeds sheets in a vertical profile (sheets are transported so that the long sides are parallel to a transport direction). The configuration of the present embodiment can be similarly applied to printers that feed sheets in a horizontal profile. Recording materials having the largest width among the widths (the widths of recording materials on a catalog) of recording materials having standard sizes supported by the apparatus are Letter sheets and Legal sheets and the width thereof is approximately 216 mm. In the present embodiment, a recording material P having a width smaller than the largest size supported by the apparatus is defined as a small-size sheet.

The heater 700 of Embodiment 3 is configured such that heating blocks HB1 to HB7 can be controlled independently as compared to the heater 300 of Embodiments 1 and 2. By controlling the temperature of the heating blocks HB1 to HB7 on the basis of a recording material size and image information, it is possible to suppress a temperature rise in a non-sheet-passing portion when a small-size sheet is passed and to reduce heating of a portion that does not require heating. In this way, it is possible to reduce power consumption of the fixing device 600.

Figure 6:
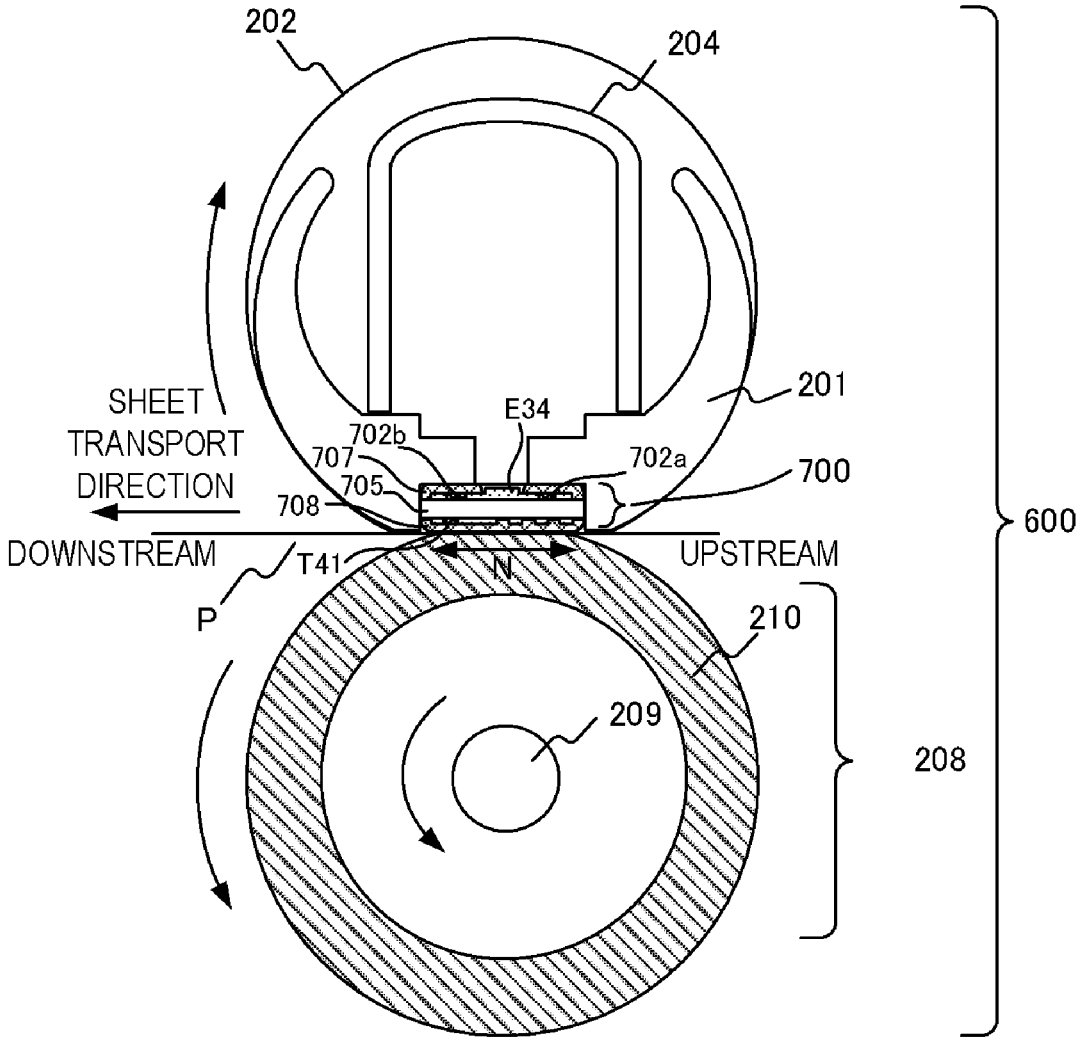
FIG. 6 is a schematic cross-sectional view of a fixing device according to Embodiment 3.

FIG. 6 is a schematic cross-sectional view of the fixing device 600 according to Embodiment 3. The fixing device 600 includes a plurality of electrodes (in this example, an electrode E34 is illustrated representatively) provided on the opposite side of the fixing nip N and a plurality of electrical contacts and electrical power is supplied from each electrical contact to each electrode. A detailed description of the heater 700 will be provided with reference to FIGS. 7A and 7B.

The heater 700 is a heater heated by a heating element 702 (702*a* and 702*b*) provided on a back surface side of a substrate 705. A surface protection layer 707 is a glass used for insulating the heating element 702. A thermistor T41 (T11 to T71 and T12 to T72) is provided on a sliding surface side of the substrate 705. A surface protection layer 708 is a glass used for protecting the thermistor T41 (T11 to T71 and T12 to T72) and obtaining slidability of the fixing nip N. Moreover, holes for connecting electrodes and electrical contacts are formed in a holding member 201 of the heater 700 and the surface protection layer 707. The detailed description will be provided with reference to FIGS. 7A and 7B.

Figure 7A:
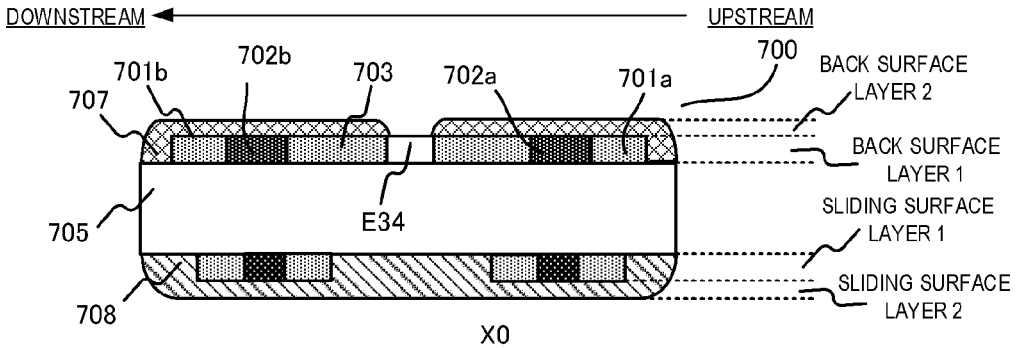
FIGS. 7A and 7B are diagrams illustrating a configuration of a heater of the fixing device according to Embodiment 3.
Figure 7B:
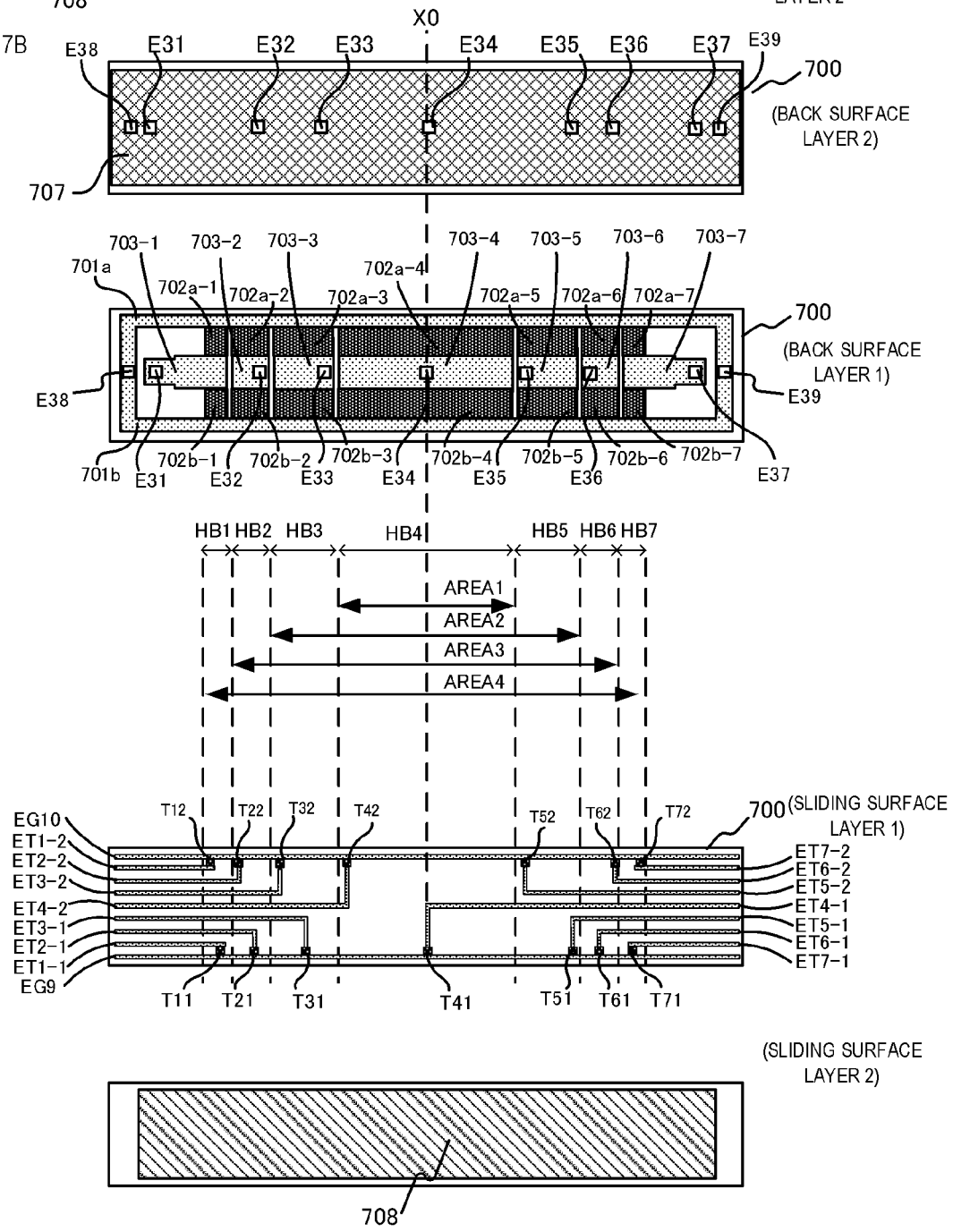

FIGS. 7A and 7B are schematic diagrams for describing a configuration of the heater 700 according to Embodiment 3. FIG. 7A illustrates a cross-sectional view near a transport reference position X0 illustrated in FIG. 7B in a lateral direction (a transport direction of the recording material P) of the heater 700. The heater 700 includes a first conductor 701 and a second conductor 703 provided on the substrate 705 along the longitudinal direction of the heater 700. The first conductor 701 (701*a* and 701*b*) and the second conductor 703 (703-4) are provided on the substrate 705 along the longitudinal direction of the heater 700 at different positions in the lateral direction of the heater 700. The first conductor 701 is divided into a conductor 701*a* disposed on the upstream side in the transport direction of the recording material P and a conductor 701*b* disposed on the downstream side.

The heating element 702 is provided between the first conductor 701 and the second conductor 703 to generate heat with the electrical power supplied via the first conductor 701 and the second conductor 703. The heating element 702 is divided into a heating element 702*a* disposed on the upstream side in the transport direction of the recording material P and a heating element 702*b* disposed on the downstream side. When a heating distribution in the lateral direction of the heater 700 is not symmetrical, the stress generated in the substrate 705 increases when the heater 700 generates heat. When the stress generated in the substrate 705 increases, breakage of the substrate 705 may occur. Due to this, the heating element 702 is divided into the heating element 702*a* disposed on the upstream side in the transport direction and the heating element 702*b* disposed on the downstream side, so that a heating distribution in the lateral direction of the heater 700 is symmetrical. Moreover, an insulating (in the present embodiment, glass) surface protection layer 707, which covers the heating element 702 and the first conductor 701 (701*a* and 701*b*) and the second conductor 703 (703-4), is provided on a back surface layer 2 of the heater 700 outside the electrode portion (E34).

FIG. 7B illustrates a plan view of respective layers of the heater 700. A plurality of heating blocks made up of a combination of the first conductor 701, the second conductor 703, and the heating element 702 is provided on a back surface layer 1 of the heater 700 in the longitudinal direction of the heater 700. The heater 700 of the present embodiment includes seven heating blocks HB1 to HB7 in total at both ends and at the center in the longitudinal direction of the heater 700. The heating blocks HB1 to HB7 include heating elements 702*a*-1 to 702*a*-7 and heating elements 702*b*-1 to 702*b*-7, respectively, formed symmetrically in the lateral direction of the heater 700. The first conductor 701 includes the conductor 701*a* connected to the heating element (702*a*-1 to 702*a*-7) and the conductor 701*b* connected to the heating element (702*b*-1 to 702*b*-7). Similarly, since the second conductor 703 corresponds to the seven heating blocks HB1 to HB7, the second conductor 703 is divided into seven conductors 703-1 to 703-7.

The electrodes E31 to E37 are electrodes used for supplying electrical power to the heating blocks HB1 to HB7 via the conductors 703-1 to 703-7, respectively. Electrodes E38 and E39 are electrodes used for connecting to a common electrical contact used for supplying electrical power to the seven heating blocks HB1 to HB7 via the conductor 701*a* and the conductor 701*b*.

The surface protection layer 707 on the back surface layer 2 of the heater 700 is formed outside the portions of the electrodes E31 to E39 and is configured such that an electrical contact (not illustrated) can be connected thereto from the back surface side of the heater 700. Electrical power can be supplied independently to the respective heating blocks and the supply of electrical power can be controlled independently. By dividing a heating block into seven heating blocks in this manner, it is possible to form four sheet-passing portions, like AREA1 to AREA4. In the present embodiment, AREA1 is used for A5 sheets, AREA2 is used for B5 sheets, AREA3 is used for A4 sheets, and AREA4 is used for Letter sheets. Since seven heating blocks can be controlled independently, a heating block to which electrical power is supplied is selected according to the size of the recording material P. The number of heating areas and the number of heating blocks are not limited to the numbers described in the present embodiment. Moreover, the heating elements 702*a*-1 to 702*a*-7 and 702*b*-1 to 702*b*-7 in the respective heating blocks are not limited to such a continuous pattern as disclosed in the present embodiment, and may be a strip-shaped pattern having a gap therebetween.

By providing electrodes on the back surface of the heater 700 in this manner, since it is not necessary to perform wiring on the substrate 705 using a conductive pattern, it is possible to shorten the width in the lateral direction of the substrate 705. Therefore, it is possible to reduce a material cost of the substrate 705 and to shorten a start-up time taken for a rise in temperature of the heater 700 due to a reduction in heat capacity of the substrate 705.

The thermistors T11 to T71 and the thermistors T12 to T72 are provided on the sliding surface layer 1 of the heater 700 to detect the temperatures of the heating blocks HB1 to HB7 of the heater 700. Since two or more thermistors are provided in each of the heating blocks HB1 to HB7, it is possible to detect the temperatures of all heating blocks even when one thermistor fails. Conductors ET1-1 to ET7-1 and conductors ET1-2 to ET7-2 for detecting the resistances of thermistors and common conductors EG9 and EG10 of thermistors are formed to energize the thermistors T11 to T71 and the thermistors T12 to T72.

The surface protection layer 708, which is a glass coating having sliding properties, is formed on the sliding surface layer 2 (the surface making contact with an endless belt) of the heater 700. The surface protection layer 708 is formed in a region at least in which the surface protection layer 708 slides on the film 202 excluding ends of the heater 700 in order to provide electrical contacts to the conductors ET1-1 to ET7-1, ET1-2 to ET7-2, EG9 and EG10 for detecting the resistances of thermistors.

In this manner, in the present embodiment, the heating element 702 is covered by the surface protection layer 707 and the substrate 705 of the heater 700, whereby insulation between the primary-side heating element 702 and the film 202 and the thermistors T11 to T71 and T12 to T72 is realized. The protection circuit block 802 and the CPU 6 achieve insulation with respect to both the primary side and the secondary side. That is, since the thermistors T11 to T71 and the thermistor T12 to T72 are insulated for both the primary side and the secondary side, it is possible to form the surface protection layer 708 as a thin layer. Moreover, since insulation is secured in the surface protection layer 708, the thermistors T11 to T71 and T12 to T72 and the conductors ET1-1 to ET7-1, ET1-2 to ET7-2, EG9, and EG10 that connect the thermistors can be disposed at arbitrary positions of the sliding surface layer of the substrate 705. Therefore, it is possible to shorten a substrate width in the lateral direction of the heater 700 and to increase the thermo-responsiveness of the heater 700.

Figure 8A:
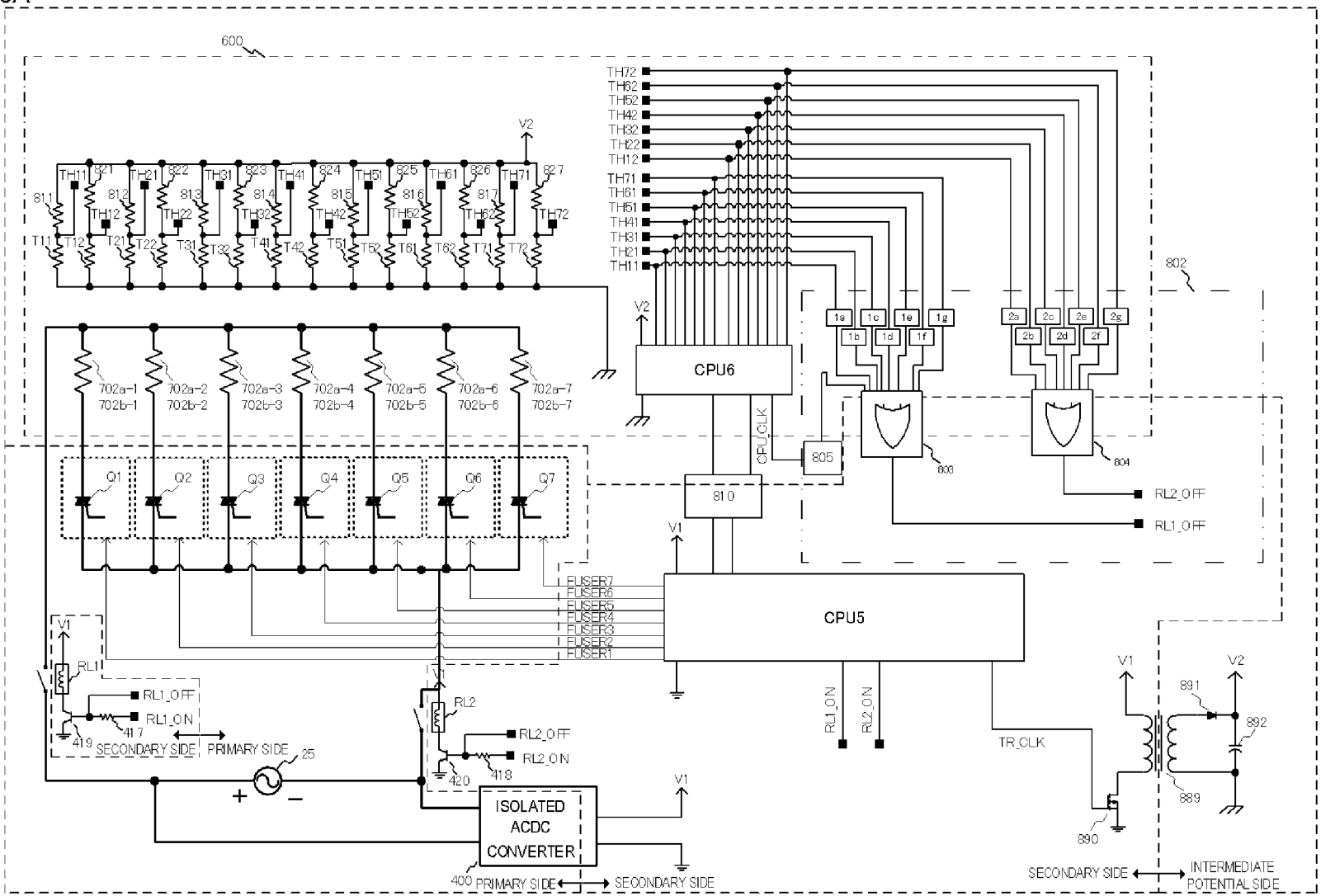
FIG. 8A is a diagram of an electrical power supply circuit that supplies electrical power to the fixing device according to Embodiment 3.
Figure 8B:
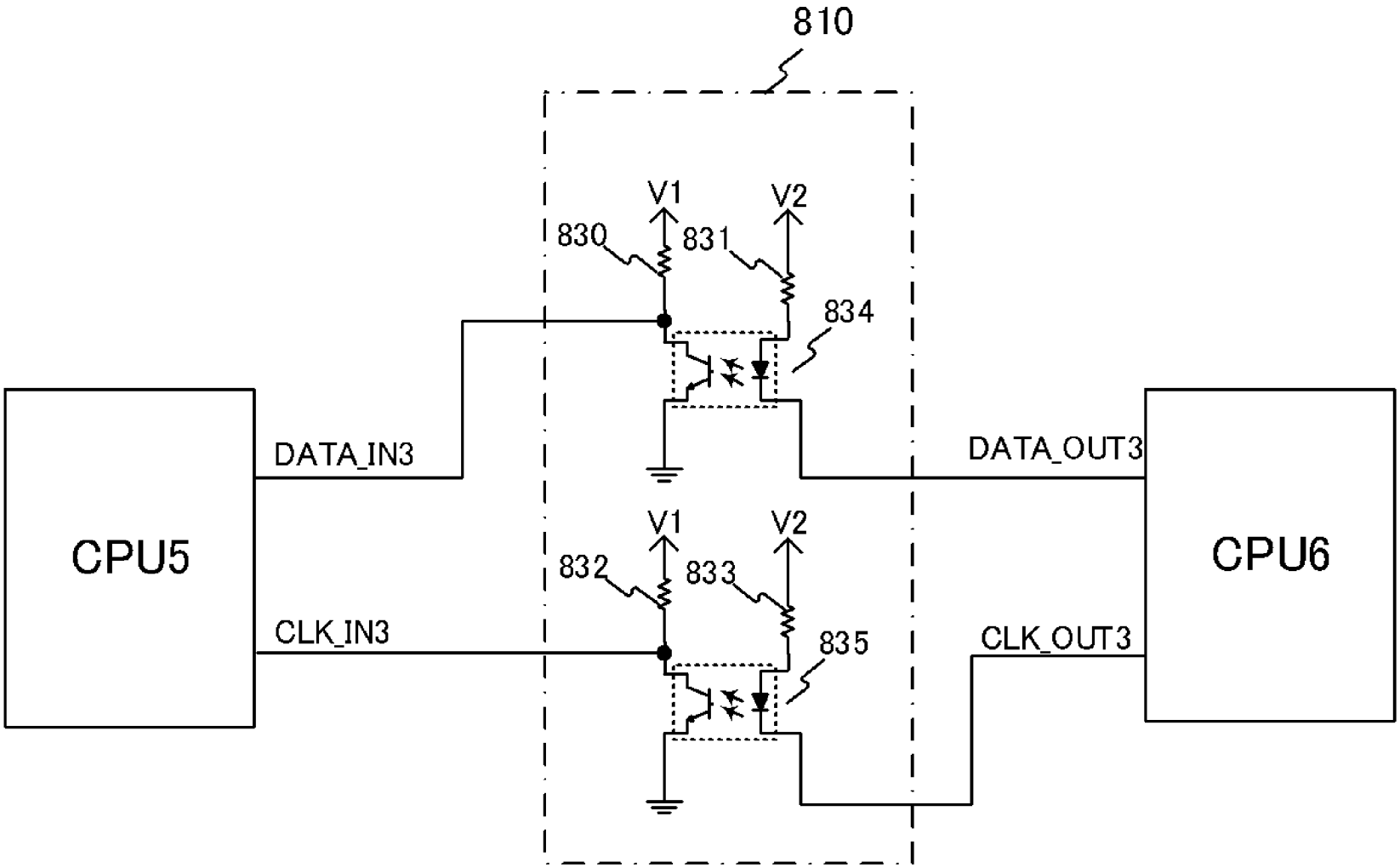
FIG. 8B is a diagram of an electrical power supply circuit that supplies electrical power to the fixing device according to Embodiment 3.
Figure 8C:
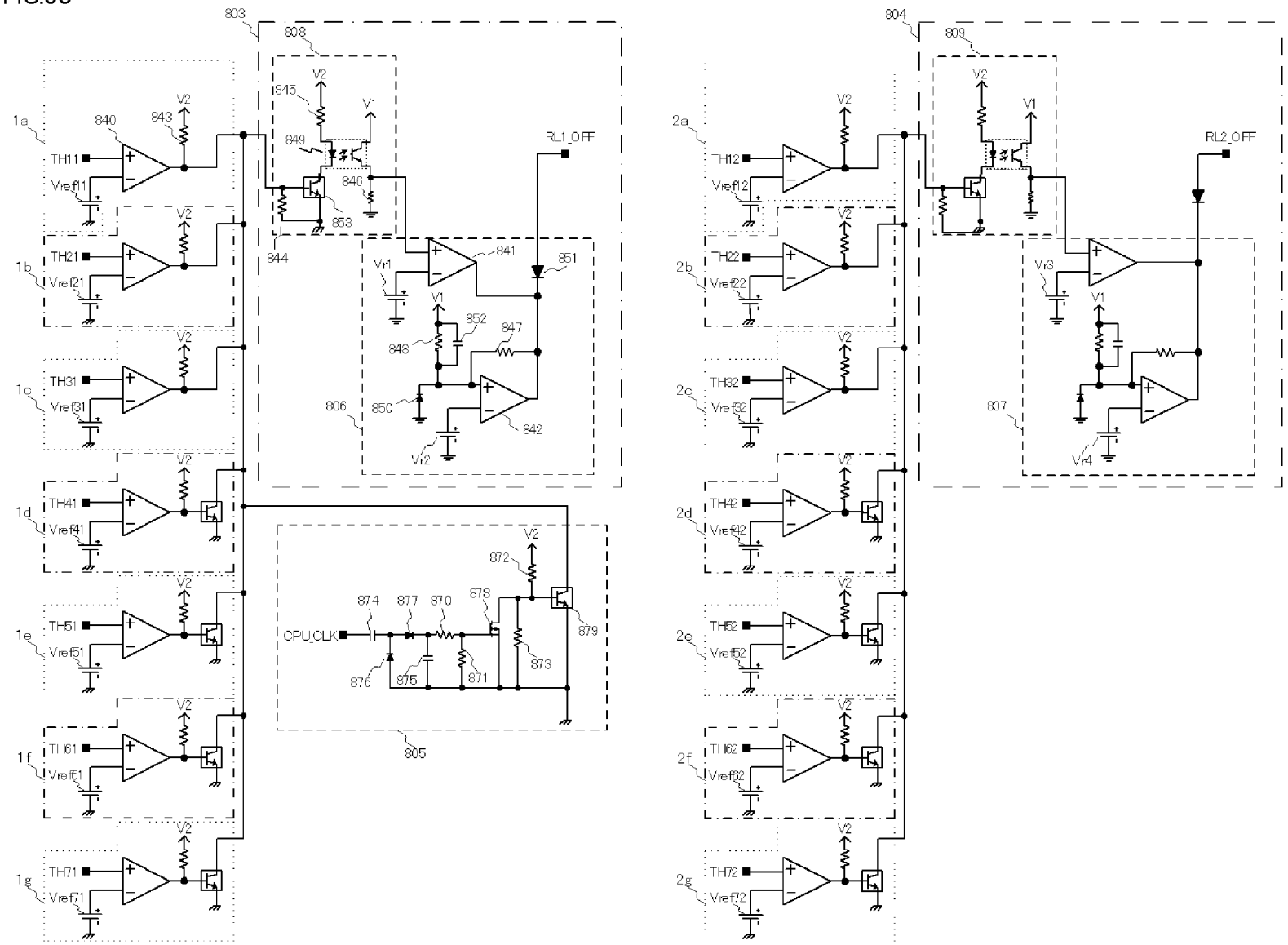
FIG. 8C is a diagram of an electrical power supply circuit that supplies electrical power to the fixing device according to Embodiment 3.

Therefore, by using the heater 700 of Embodiment 3 and the electrical power supply circuit described in FIGS. 8A to 8C, it is possible to improve the thermo-responsiveness and the heat-transmission efficiency of the heater, as well as the accuracy of detection of the nip temperature of the thermistor, while maintaining a dielectric to withstand voltage of the fixing device 600.

FIG. 8A illustrates a circuit diagram of an electrical power supply circuit that supplies electrical power to the fixing device 600 according to Embodiment 3. The electrical power supply circuit is a circuit that supplies electrical power from the AC power supply 25 to the heating element 702 inside the fixing device 600 and controls temperature so that a predetermined temperature is maintained. The voltage V1 generated by an isolated AC/DC converter 400 is supplied to a CPU 5, and the CPU 5 disposed on the secondary side controls an image forming process and driving of a driving element (not illustrated) of the laser printer 10. The thermistors T11 to T71 and T12 to T72, the peripheral circuit, and the abnormality detection portions 1*a* to 1*g* and 2*a* to 2*g*, and the CPU 6 are disposed on an intermediate potential side isolated from the primary side and the secondary side.

Next, an operation of a transformer 889 generating the voltage V2 will be described. The transformer 889 is an insulated transformer used for generating the voltage V2 from the secondary-side voltage V1 and is insulated. An N-ch MOSFET 890 is switched according to a signal TR_CLK of the CPU 5, whereby a voltage is output. A diode 891 and a capacitor 892 rectify and smooth the output of the transformer 889, whereby a stable voltage V2 is generated.

An isolated communication unit 810 is an isolated communication circuit between the CPU 5 and the CPU 6. The CPU 5 is disposed on the secondary side to control electrical power supplied to the switching elements (RL1, RL2, and Q1 to Q7) on the basis of the temperature information of the thermistor acquired from the isolated communication unit 810 from the CPU 6.

The protection circuit block 802 is a circuit that stops the supply of electrical power to the heating element 702 on the basis of the signals TH11 to TH71 and the signals TH12 to TH72.

Electrical power is supplied from the AC power supply 25 connected to the laser printer 10 to the heating element 702 inside the heater 700 via the relays RL1 and RL2 and the triacs Q1 to Q7, whereby the heating element 702 (702*a*-1 and 702*b*-1) generates heat. When the heating elements 702*a*-1 and 702*b*-1 are heated, the relays RL1 and RL2 and the triac Q1 are operated. Moreover, when the other heating elements 702-2 to 702-7 are heated, the triacs Q2 to Q7 are operated, respectively. Since the operations of the relays RL1 and RL2 and the triacs Q1 to Q7 are similar to those of Embodiment 1, the description thereof will be omitted.

Next, temperature detection by the thermistors T11 to T71 and the thermistors T12 to T72 will be described. The temperature detected by the thermistor T11 is detected by the CPU 6 as a signal TH11, which is a voltage obtained by dividing the voltage V2 by a resistor 811 and the thermistor T11. The temperature detected by the thermistor T21 is detected by the CPU 6 as a signal TH21, which is a voltage obtained by dividing the voltage V2 by a resistor 812 and the thermistor T21. The temperature detected by the thermistor T31 is detected by the CPU 6 as a signal TH31, which is a voltage obtained by dividing the voltage V2 by a resistor 813 and the thermistor T31. The temperature detected by the thermistor T41 is detected by the CPU 6 as a signal TH41, which is a voltage obtained by dividing the voltage V2 by a resistor 814 and the thermistor T41. The temperature detected by the thermistor TM is detected by the CPU 6 as a signal TH51, which is a voltage obtained by dividing the voltage V2 by a resistor 815 and the thermistor TM. The temperature detected by the thermistor T61 is detected by the CPU 6 as a signal TH61, which is a voltage obtained by dividing the voltage V2 by a resistor 816 and the thermistor T61. The temperature detected by the thermistor T71 is detected by the CPU 6 as a signal TH71, which is a voltage obtained by dividing the voltage V2 by a resistor 817 and the thermistor T71. The temperature detected by the thermistor T12 is detected by the CPU 6 as a signal TH12, which is a voltage obtained by dividing the voltage V2 by a resistor 821 and the thermistor T21. The temperature detected by the thermistor T22 is detected by the CPU 6 as a signal TH22, which is a voltage obtained by dividing the voltage V2 by a resistor 822 and the thermistor T22. The temperature detected by the thermistor T32 is detected by the CPU 6 as a signal TH32, which is a voltage obtained by dividing the voltage V2 by a resistor 823 and the thermistor T32. The temperature detected by the thermistor T42 is detected by the CPU 6 as a signal TH42, which is a voltage obtained by dividing the voltage V2 by a resistor 824 and the thermistor T42. The temperature detected by the thermistor T52 is detected by the CPU 6 as a signal TH52, which is a voltage obtained by dividing the voltage V2 by a resistor 825 and the thermistor T52. The temperature detected by the thermistor T62 is detected by the CPU 6 as a signal TH62, which is a voltage obtained by dividing the voltage V2 by a resistor 826 and the thermistor T62. The temperature detected by the thermistor T72 is detected by the CPU 6 as a signal TH72, which is a voltage obtained by dividing the voltage V2 by a resistor 827 and the thermistor T72.

FIG. 8B is a circuit diagram illustrating an example of the isolated communication unit 810 in FIG. 8A. The isolated communication unit 810 includes the resistors 830 to 833, a photocoupler 834, and a photocoupler 835. The temperature detected by the CPU 6 is output as signals CLK_OUT3 and DATA_OUT3, which are transmitted to the secondary side CPU 7 as signals CLK_IN3 and DATA_IN3, respectively. The signals CLK_OUT3, DATA_OUT3, CLK_IN3, and DATA_IN3 are isolated by the photocoupler 834 and the photocoupler 836.

In this manner, the temperature information of the heater 700 detected by the thermistors TH11 to TH71 and TH12 to TH72 is transmitted from the CPU 6 to the CPU 5, and the CPU 5 controls the electrical power supplied from the AC power supply 25 to the heater 700 on the basis of the temperature information of the heater 700. In internal processing of the CPU 5, electrical power to be supplied is calculated by PI control, for example, on the basis of the setting temperature of the heater 700 and the temperature information of the thermistors. Furthermore, the electrical power to be supplied is converted to a control level of a phase angle (phase control) or a wave-number (wave-number control), and the triacs Q1 to Q7 are controlled according to the control condition.

FIG. 8C illustrates an example of the protection circuit block 802 in FIG. 8A. The protection circuit block 802 includes abnormality detection portions 1*a* to 1*g*, abnormality detection portions 2*a* to 2*g*, a pulse detection circuit 805, a protection circuit 803, and a protection circuit 804. The protection circuit 803 is connected to the abnormality detection portions 1*a* to 1*g* and includes an abnormality transmission portion 808 and a latch circuit 806. The protection circuit 804 is connected to the abnormality detection portions 2*a* to 2*g* and includes an abnormality transmission portion 809 and a latch circuit 807.

The abnormality detection portions 1*a* to 1*g* are circuits that operate on the basis of voltages of signals TH11 to TH71 changing according to the temperatures of the thermistors T11 to T71. In the drawing, reference numerals VREF 11 to Vref71 and Vref12 to Vref72 are predetermined abnormality voltage thresholds and reference numerals 840 to 842 are open-collector comparators. Moreover, reference numerals 843 to 848 are resistors, reference numeral 849 is a photocoupler, reference numerals 850 and 851 are diodes, reference numeral 852 is a capacitor, and reference numeral 853 is an NPN transistor.

Next, an operation of the protection circuit 803 in a normal state will be described. Since the thermistor T11 in FIG. 8A has NTC characteristics, when the temperature of the thermistor T11 is low, the resistance value of the thermistor T11 increases and the voltage level of the signal TH11 increases. The voltage level of the signal TH11 is sufficiently greater than a predetermined abnormality voltage threshold Vref11 when the supply of electrical power to the heating elements 702*a*-1 and 702*b*-1, the temperature detection by the CPU 6, and the temperature control of the CPU 5 are performed normally. Therefore, the output of the comparator 840 enters into an open-collector state. Therefore, since the base terminal of the NPN transistor 853 changes to the High state, the NPN transistor 853 enters into the ON state. Since a current flows into an emission side of the photocoupler 849, a reception-side transistor also enters into the ON state and the positive (+) terminal of the comparator 841 changes to the High state. Since the voltage of the positive (+) terminal of the comparator 841 is greater than the predetermined latching threshold Vr1, the output of the comparator 841 changes to an open-collector state.

Since the voltage V1 is sufficiently greater than the predetermined latching threshold Vr2 of the comparator 842 of the latch circuit 806, the voltage of the positive (+) terminal of the comparator 842 becomes greater than the voltage of the negative (−) terminal and the output of the comparator 842 changes to an open-collector state. Therefore, the diode 851 enters into the OFF state and the signal RL1_OFF does not put the NPN transistor 419 into the OFF state.

Next, an operation of the protection circuit 803 when the heating element 702 generates heat abnormally will be described. Since the thermistor T11 in FIG. 8A has NTC characteristics, when the temperature of the thermistor T11 increases, the resistance of the thermistor T11 decreases and the voltage level of the signal TH11 decreases. The heating elements 702*a*-1 and 702*b*-1 may generate heat abnormally when the supply of electrical power to the heating elements 702*a*-1 and 702*b*-1, the temperature detection by the CPU 6, and the temperature control of the CPU 5 are not performed normally. In this case, since the voltage level of the signal TH11 becomes less than the predetermined abnormality voltage threshold Vref11, the output of the comparator 840 changes to the Low state. Therefore, since a current flows into the output terminal of the comparator 840 via the resistor 843, the NPN transistor enters into the OFF state. Since a voltage is not supplied to the emission side of the photocoupler 846, a reception-side transistor also enters into the OFF state, and the positive (+) terminal of the comparator 841 changes to the Low state. Since the voltage of the positive (+) terminal of the comparator 841 is less than the predetermined abnormality voltage threshold Vr1, the output of the comparator 841 changes to the Low state, and the signal RL1_OFF is changed to the Low state via the diode 851. As illustrated in FIG. 8A, when the signal RL1_OFF changes to the Low state, the NPN transistor 419 for driving the relay RL1 enters into the OFF state regardless of the signal RL1_ON and the relay RL1 also enters into the OFF state. Therefore, it is possible to stop the supply of electrical power from the AC power supply 25 to the heating element 702.

When the output of the comparator 841 changes to the Low state, the voltage of the positive (+) terminal of the comparator 842 also changes to the Low state via the resistor 847. Since the voltage of the positive (+) terminal of the comparator 842 is less than the predetermined latching threshold Vr2 of the comparator 842 of the latch circuit 806, the output of the comparator 842 changes to the Low state. In this way, it is possible to maintain the stopped state of the supply of electrical power to the heating element 702 until the power (not illustrated) of the comparator 842 is reset.

Since the operations of the abnormality detection portions 1*b* to 1*g* and the abnormality detection portions 2*a* to 2*g* are similar to that of the abnormality detection portion 1*a*, the description thereof will be omitted. Moreover, the protection circuit 804 independent from the protection circuit 803 is provided in order to secure the function of protection portion when hardware represented by the protection circuit 803 or the NPN transistor 419 fails. Since the operation of the protection circuit 804 is similar to that of the protection circuit 803, the description thereof will be omitted.

Next, an operation of the pulse detection circuit 805 will be described. Reference numerals 870 to 873 are resistors, reference numerals 874 and 875 are capacitors, reference numerals 876 and 877 are diodes, reference numeral 878 is an N-ch MOSFET, and reference numeral 879 is an NPN transistor. The CPU 6 outputs a predetermined pulse signal CPU_CLK when it operates normally, and the signal CPU_CLK is fixed to the High (or Low) state when the CPU 6 does not operate normally.

A case in which the CPU 6 operates normally will be described. Since the signal CPU_CLK is a pulse signal, the signal CPU_CLK is AC-coupled by the capacitor 874 and is rectified and smoothed by the diodes 876 and 877 and the capacitor 875, and a High-level voltage is applied to the gate electrode of the MOSFET 878. The MOSFET 878 enters into the ON state and a current flows through the resistor 872. The base voltage of the NPN transistor changes to the Low state and the NPN transistor 879 enters into the OFF state. Therefore, the signal RL1_OFF does not put the NPN transistor 419 into the OFF state.

Next, a case in which the CPU 6 does not operate normally due to noise, or the like, will be described. Since the signal CPU_CLK is in the High (or Low) state, the signal CPU_CLK is not transmitted to the capacitor 874 and the gate voltage of the MOSFET 878 changes to the Low state. The MOSFET 878 enters into the OFF state, and the voltage V2 is applied to the base terminal of the NPN transistor 879 via the resistor 872. The NPN transistor 879 enters into the ON state, the base of the NPN transistor 853 connected to the collector of the NPN transistor 879 changes to the Low state. When the base of the NPN transistor 853 changes to the Low state, the signal RL1_OFF changes to the Low state and the relay RL1 enters into the OFF state.

According to the pulse detection circuit 805, even when the CPU 6 does not operate normally due to noise, or the like, it is possible to stop the supply of electrical power from the AC power supply 25 to the heating element 702. Moreover, even when the CPU 6 operates normally, when the CPU 6 detects an abnormal temperature, the signal CPU_CLK outputs the High (or Low) signal, and it is possible to stop the supply of electrical power from the AC power supply 25 to the heating element 702.

In the present embodiment, the heating element 602, the thermistors T11 to T71 and T12 to T72, and the abnormality detection portions 1*a* to 1*g* and 2*a* to 2*g* are disposed inside the fixing device 600. Generally, the fixing device 600 is detachably configured and is connected to the laser printer 10 using a connector, or the like. By arranging signals after OR-connection on the side of the fixing device 600 and arranging latch circuits, and the like, after OR-connection on the side of the laser printer, like the present embodiment, it is possible to decrease the number of pins necessary for connecting the fixing device 600 and the laser printer 10 as compared to Embodiments 1 and 2.

As illustrated in FIG. 8C, in the present embodiment, the voltage V2 is used as the power supply on the emission side of the photocoupler 846, and the supply of electrical power from the AC power supply 25 to the heating element 702 can be stopped when the photocoupler 846 does not emit light. With such a configuration, it is possible to stop the supply of electrical power from the AC power supply 25 to the heating element 702 in the event of a certain abnormality. Examples of an abnormal event include a case in which a component, such as the MOSFET 890, fails, a case in which the voltage V2 is not output, and a case in which the voltage V2 is not transmitted to the fixing device 600 because a connector (not illustrated) is not connected.

The protection circuit block 802 may stop the supply of electrical power to the heating element 702 upon detecting an abnormality in anyone of the thermistors T11 to T71 and T12 to T72. Therefore, it is not necessary to specify an abnormal thermistor. Therefore, as illustrated in FIGS. 8A and 8C, by OR-connecting the abnormality detection portions 1*a* to 1*g* to the abnormality transmission portion 808, the supply of electrical power to the heating element 702 can be stopped when any one of the abnormality detection portions detects an abnormality. Moreover, even when the CPU 6 operates abnormally due to noise, or the like, it is possible to stop the supply of electrical power from the AC power supply 25 to the heating element 702.

As described above, in the present embodiment, in a configuration in which a driving circuit of electrical power control unit is disposed on the secondary side, and the thermistors and the abnormality detection portions are disposed on a potential side insulated from the primary side and the secondary side, the abnormality detection circuit and the pulse detection circuit are OR-connected to the abnormality transmission portion. By doing so, it is possible to secure the function of a necessary protection portion without increasing the number of abnormality transmission portions and latch circuits to correspond to the number of thermistors.

Embodiment 4

In Embodiment 4 of the present invention, a contact side of the relay RL1 is connected to the AC power supply 25 and a coil side of the relay RL1 and the NPN transistor 419 are connected to the intermediate potential V2 so that the relay can be turned off without use of an insulating element, such as a photocoupler. According to such a configuration, it is possible to form a protection circuit with a lower-cost configuration. Components similar to those of the above-described embodiments among components of Embodiment 4 will be denoted by the same reference numerals, and the description thereof will be omitted. In Embodiment 4, matters that are not described particularly herein are similar to those of the above-described embodiments.

Figure 9A:
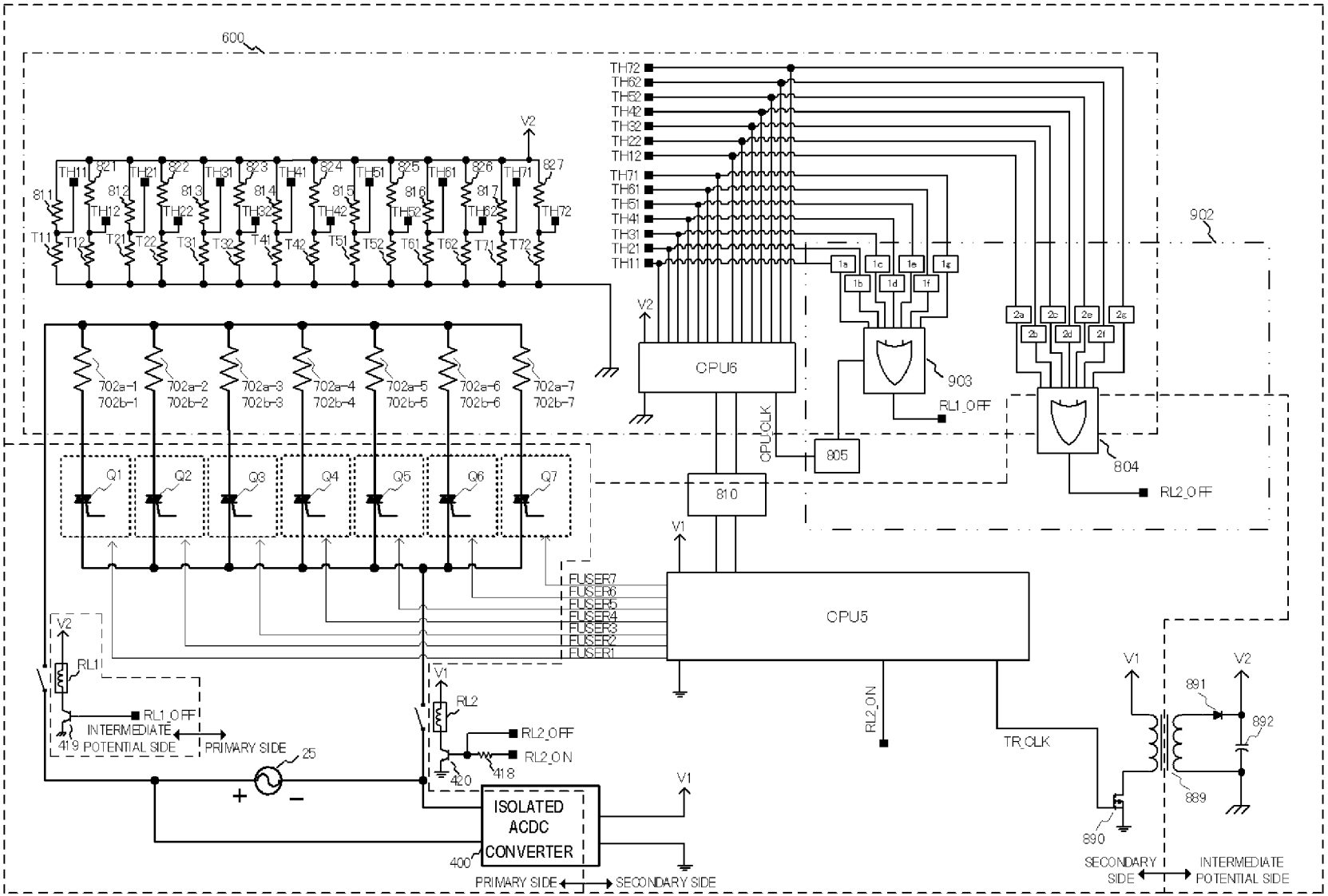
FIG. 9A is a diagram of an electrical power supply circuit that supplies electrical power to a fixing device according to Embodiment 4.
Figure 9B:
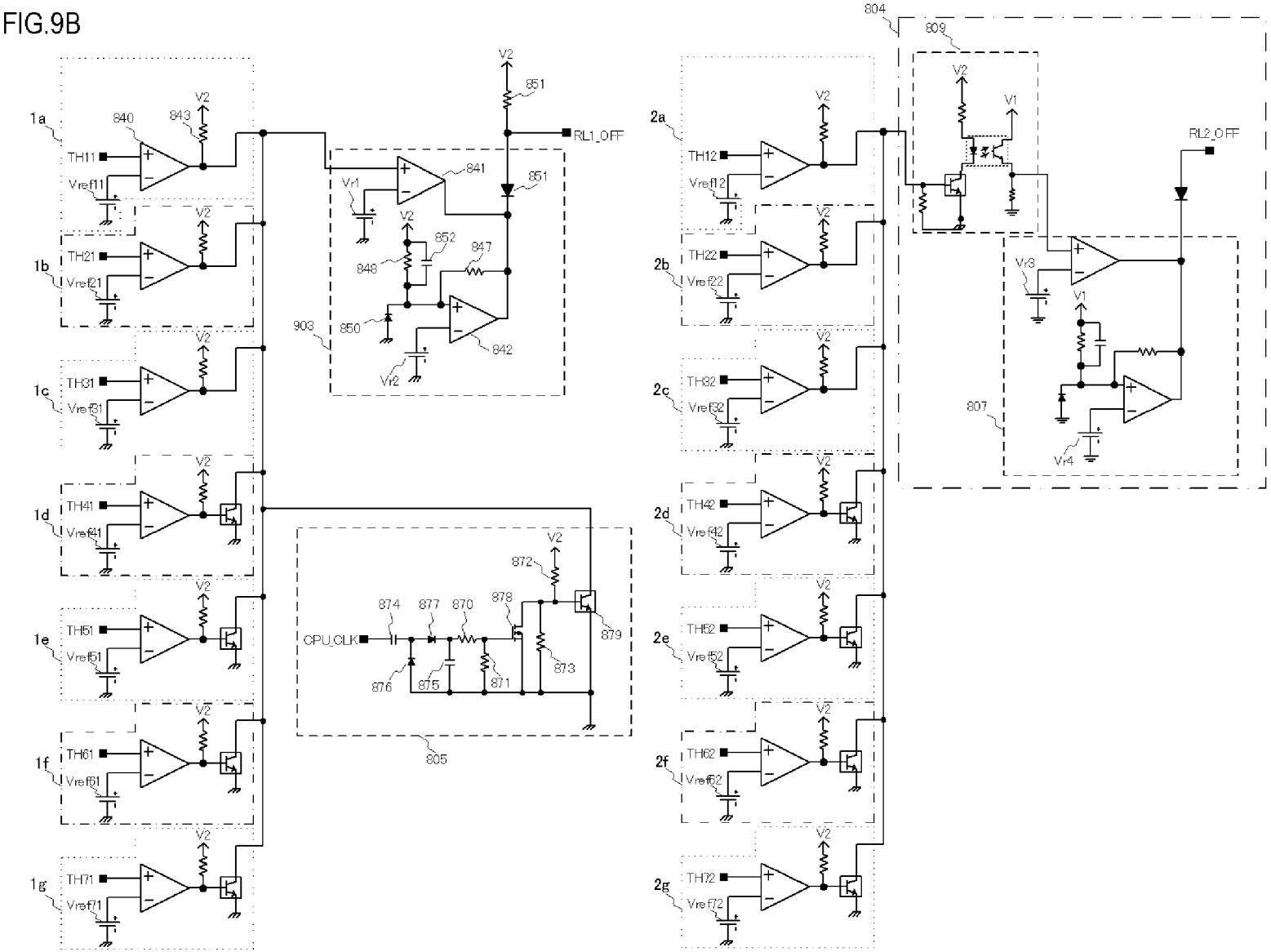
FIG. 9B is a diagram of an electrical power supply circuit that supplies electrical power to the fixing device according to Embodiment 4.

Embodiment 4, in which the fixing device 600 and the heater 700 are mounted on the laser printer 10, will be described with reference to FIGS. 9A and 9B. FIG. 9A is a circuit diagram of an electrical power supply circuit that supplies electrical power to the fixing device 600 according to Embodiment 4. Unlike Embodiment 3, the relay RL1 is disposed on the primary side and the intermediate potential side. Moreover, the protection circuit 903 is disposed on the intermediate potential side. FIG. 9B illustrates an example of the protection circuit block 902 in FIG. 9A. The protection circuit block 902 includes abnormality detection portions 1*a* to 1*g*, abnormality detection portions 2*a* to 2*g*, a pulse detection circuit 805, a protection circuit 804, and a protection circuit 903.

Next, an operation of the protection circuit 903 in a normal state will be described. Since the thermistor T11 in FIG. 9A has NTC characteristics, when the temperature of the thermistor T11 is low, the resistance value of the thermistor T11 increases and the voltage level of the signal TH11 increases. The voltage level of the signal TH11 is sufficiently greater than a predetermined abnormality voltage threshold Vref11 when the supply of electrical power to the heating elements 702*a*-1 and 702*b*-1, the temperature detection by the CPU 6, and the temperature control of the CPU 5 are performed normally. Therefore, the output of the comparator 840 enters into an open-collector state. Since the voltage of the positive (+) terminal of the comparator 841 is greater than the predetermined latching threshold Vr1, the output of the comparator 841 changes to an open-collector state.

Since the voltage V2 is sufficiently greater than the predetermined latching threshold Vr2 of the comparator 842, the voltage of the positive (+) terminal of the comparator 842 becomes greater than the voltage of the negative (−) terminal and the output of the comparator 842 changes to an open-collector state. Therefore, the diode 851 enters into the OFF state and the signal RL1_OFF does not put the NPN transistor 419 into the OFF state since the signal RL1_OFF changes to the HIGH state via the resistor 851.

Next, an operation of the protection circuit 903 when the heating element 702 generates heat abnormally will be described. Since the thermistor T11 in FIG. 9A has NTC characteristics, when the temperature of the thermistor T11 increases, the resistance of the thermistor T11 decreases and the voltage level of the signal TH11 decreases. The heating elements 702*a*-1 and 702*b*-1 may generate heat abnormally when the supply of electrical power to the heating elements 702*a*-1 and 702*b*-1, the temperature detection by the CPU 6, and the temperature control of the CPU 5 are not performed normally. In this case, since the voltage level of the signal TH11 becomes less than the predetermined abnormality voltage threshold Vref11, the output of the comparator 840 changes to the Low state. Therefore, since a current flows into the output terminal of the comparator 840 via the resistor 843, the positive (+) terminal of the comparator 841 changes to the Low state. Since the voltage of the positive (+) terminal of the comparator 841 is less than the predetermined abnormality voltage threshold Vr1, the output of the comparator 841 changes to the Low state and the signal RL1_OFF changes to the Low state via the diode 851. As illustrated in FIG. 9A, when the signal RL1_OFF changes to the Low state, the NPN transistor 419 for driving the relay RL1 enters into the OFF state and the relay RL1 also enters into the OFF state. Therefore, it is possible to stop the supply of electrical power from the AC power supply 25 to the heating element 702.

When the output of the comparator 841 changes to the Low state, the voltage of the positive (+) terminal of the comparator 842 also changes to the Low state via the resistor 847. Since the voltage of the positive (+) terminal of the comparator 842 is less than the predetermined latching threshold Vr2 of the comparator 842, the output of the comparator 842 changes to the Low state. In this way, it is possible to maintain the stopped state of the supply of electrical power to the heating element 702 until the power (not illustrated) of the comparator 842 is reset.

As described above, by arranging the abnormality detection circuit on the intermediate potential side and arranging the relay so that insulation is achieved between the primary side and the intermediate potential side, since it is not necessary to isolate the ON and OFF signals of the relay, it is possible to form a protection portion with an inexpensive configuration.

Embodiment 5

In Embodiment 5 of the present invention, a coil side of the relay RL1 is connected serially to the ground (GND) via the conductors EG9 and EG10 of the heater 700 and a temperature protection element 1000, such as a thermoswitch. According to such a configuration, it is possible to form the protection circuit with an inexpensive configuration. Components similar to those of the above-described embodiments among components of Embodiment 5 will be denoted by the same reference numerals, and the description thereof will be omitted. In Embodiment 5, matters that are not described particularly herein are similar to those of the above-described embodiments.

Figure 10:
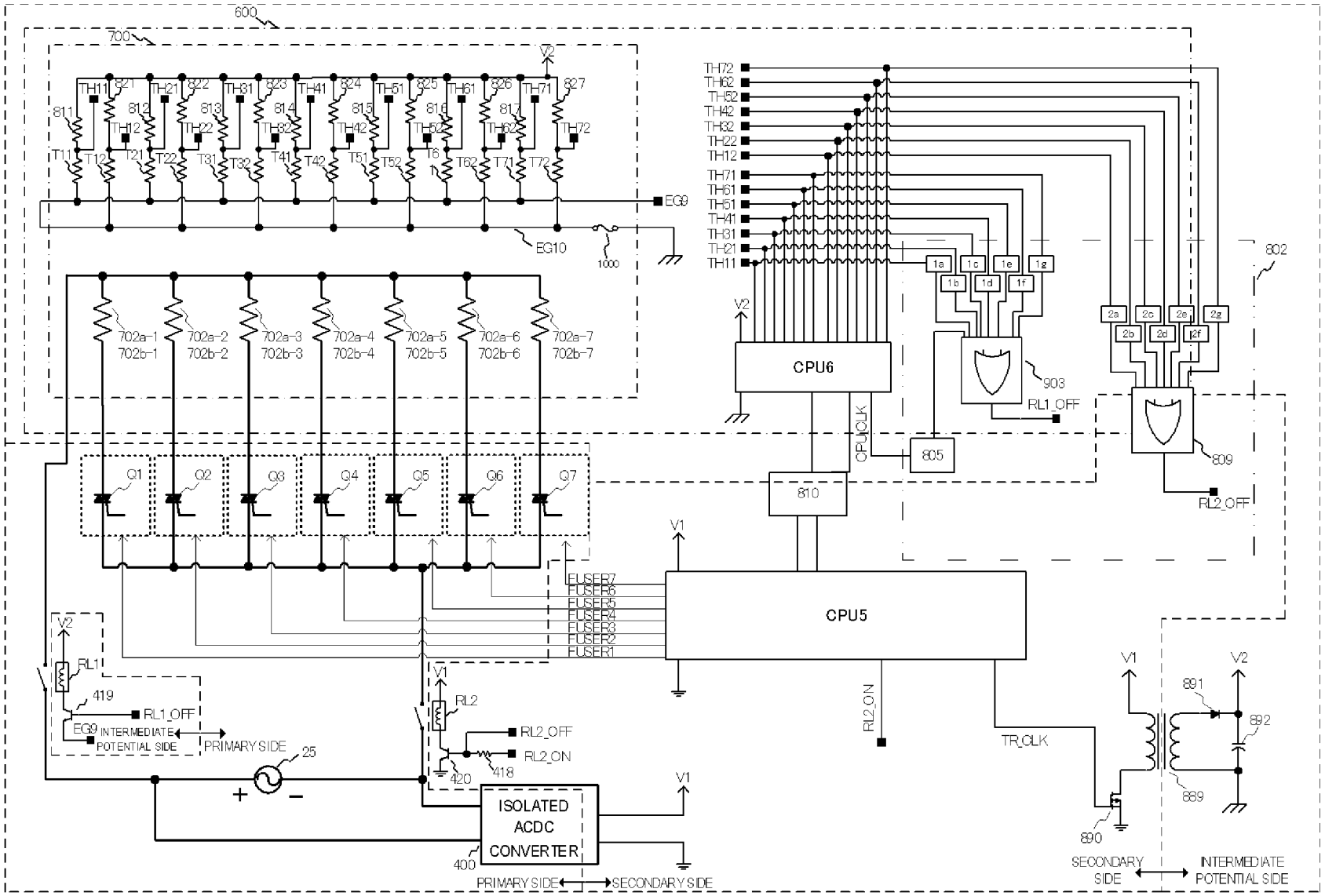
FIG. 10 is a diagram of an electrical power supply circuit that supplies electrical power to a fixing device according to Embodiment 5.

Embodiment 5, in which the fixing device 600 and the heater 700 are mounted on the laser printer 10, will be described with reference to FIG. 10. FIG. 10 is a circuit diagram of an electrical power supply circuit that supplies electrical power to the fixing device 600 according to Embodiment 5.

An operation of the relay RL1 in a normal state will be described. As illustrated in FIG. 10, a coil side of the relay RL1 is connected to the collector terminal of the NPN transistor 419, and the emitter terminal of the NPN transistor 419 is connected to one terminal of the conductor EG9 of the heater 700. The other terminal of the conductor EG9 is connected to one terminal of the conductor EG10 on the same lateral side as the heater 700, and the other terminal of the conductor EG10 is connected to the ground (GND) in series to the temperature protection element 1000.

As described in Embodiment 4, the signal RL1_OFF in a normal state is in the High state. Since a current flows into the coil side of the relay RL1 from the intermediate potential V2 via the NPN transistor 419, the conductor EG9, the conductor EG10, and the temperature protection element 1000, the contact side of the relay RL1 changes to the conduction state.

An operation when the heating element 702 generates heat abnormally will be described. The heater 700 may be overheated to an abnormal temperature when temperature control is not performed but the heater 700 is overheated continuously due to failures in the thermistors T11 to T71 and T12 to T72 and failures in the CPU. In this case, thermal stress may occur in the heater 700, and an abnormal state, such as breakage, fragments, or cracks may be formed in the heater 700 formed of a ceramic plate. In this case, when the conductor EG9 or the conductor EG10 is disconnected, since a current does not flow into the coil side of the relay RL1, the contact side of the relay RL1 enters into an open state. Therefore, it is possible to stop the supply of electrical power from the AC power supply 25 to the heating element 702.

Even when the heater 700 is heated abnormally and the temperature protection element 1000 enters into the open state, since a current does not flow into the coil side of the relay RL1, it is possible to stop the supply of electrical power from the AC power supply 25 to the heating element 702.

As described above, in the present embodiment, the coil side of the relay RL1 is serially connected via the conductors EG9 and EG10 of the heater 700 and the temperature protection element 1000, such as a thermo-switch, which form a conduction path to the heater. By doing so, since the relay RL1 can be put into the OFF state when any one of the conductor EG9 or EG10 and the temperature protection element 1000 enters into the open state, it is possible to form a protection portion at a low cost.

The respective components of the above-described embodiments can be combined with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a heater including a heating element that generates heat by energization, for heating an image formed on a recording material;

a driving unit that supplies electrical power to the heating element;

a plurality of temperature detection portions, each temperature detection portion detecting a temperature of the heater, the plurality of temperature detection portions being connected to a first circuit;

a control unit that controls the driving unit on the basis of the temperatures detected by the plurality of temperature detection portions, the control unit being connected to a second circuit, which is isolated from the first circuit;

a relay having a coil connected to the second circuit, and having a contact on a conduction path to the heater in the first circuit, the relay being disconnected according to a signal indicating an abnormality in the heater;

a plurality of abnormality detection circuit portions that output signals corresponding to the temperatures detected by the plurality of temperature detection portions, the plurality of abnormality detection circuit portions being connected to the first circuit; and an abnormality transmission circuit portion that transmits a signal indicating the abnormality in the heater to the coil on the basis of the signals output by the abnormality detection circuit portions, the abnormality transmission circuit portion transmitting the signal indicating the abnormality in the heater to the coil on the basis of at least one of the signals output by the plurality of abnormality detection circuit portions, wherein the plurality of abnormality detection circuit portions are OR-connected to the abnormality transmission circuit portion.

2. The image forming apparatus according to claim 1, further comprising a transformer that defines a primary-side circuit and a secondary-side circuit, wherein the heater is connected to the primary-side circuit that is connected to an alternating current (AC) power supply that supplies electrical power to be supplied to the heating element, the first circuit is the primary-side circuit, and the second circuit is the secondary-side circuit, which is isolated from the primary-side circuit.

3. The image forming apparatus according to claim 1, further comprising a transformer that defines a primary-side circuit and a secondary-side circuit, wherein the heater is connected to the primary-side circuit that is connected to an alternating current (AC) power supply that supplies electrical power to be supplied to the heating element, the first circuit is the secondary-side circuit, which is isolated from the primary-side circuit, and the second circuit is the primary-side circuit.

4. The image forming apparatus according to claim 1, further comprising a transformer that defines a primary-side circuit and a secondary-side circuit, wherein the heater is connected to the primary-side circuit that is connected to an alternating current (AC) power supply that supplies electrical power to be supplied to the heating element, the second circuit is the secondary-side circuit, which is isolated from the primary-side circuit, and the first circuit is a circuit, which is isolated from the primary-side circuit and the secondary-side circuit.

5. The image forming apparatus according to claim 1, wherein the heater includes a plurality of heating areas, at least two temperature detection portions, of the plurality of temperature detection portions, detect one of the heating areas, and the at least two temperature detection portions are connected to different abnormality detection circuit portions, of the plurality of abnormality detection circuit portions.

6. The image forming apparatus according to claim 1, further comprising an electrical power supply unit for supplying electrical power to the first circuit, wherein, when the signal indicating the abnormality in the heater is transmitted from the abnormality transmission circuit portion to the control unit, the electrical power supply unit stops the supply of electrical power and the supply of electrical power to the heating element is stopped.

7. The image forming apparatus according to claim 1, further comprising:

a central processing unit (CPI) disposed on the first circuit; and a protection circuit that stops the supply of electrical power to the heating element on the basis of a pulse signal output by the CPU.

8. The image forming apparatus according to claim 7, wherein the CPU stops the output of the pulse signal according to the temperatures detected by the plurality of temperature detection portions.

9. The image forming apparatus according to claim 1, further comprising a cylindrical film being contact with the recording material bearing the image, wherein the heater is in contact with an inner surface of the film, and wherein the image formed on the recording material is heated by the heater through the film.

10. The image forming apparatus according to claim 9, further comprising a roller that forms a nip portion for nipping and conveying the recording material in cooperation with the heater through the film.

11. An image forming apparatus comprising:

a heater including a heating element that generates heat by energization, for heating an image formed on a recording material, the heater being connected to a first circuit that is connected to an alternating current (AC) power supply;

a driving unit that supplies electrical power to the heating element, the driving unit being connected to a second circuit, which is isolated from the first circuit;

a plurality of temperature detection portions, each temperature detecting portion detecting a temperature of the heater, the plurality of temperature detection portions being connected to a third circuit, configured to be isolated from the first circuit and the second circuit;

a plurality of abnormality detection circuit portions that output signals corresponding to the temperatures detected by the plurality of temperature detection portions, the plurality of abnormality detection circuit portions being connected to the third circuit; and a relay having a coil connected to the third circuit, and having a contact on a conduction path to the heater in the first circuit, wherein the relay is disconnected according to the signals output by the plurality of abnormality detection circuit portions, an abnormality transmission circuit portion that transmits a signal indicating the abnormality in the heater to the coil on the basis of the signals output by the abnormality detection circuit portions, the abnormality transmission circuit portion transmitting the signal indicating the abnormality in the heater to the coil on the basis of at least one of the signals output by the plurality of abnormality detection circuit portions, wherein the plurality of abnormality detection circuit portions are OR-connected to the abnormality transmission circuit portion.

12. The image forming apparatus according to claim 11, further comprising a temperature protection element connected to the third circuit, wherein, when the temperature protection element is disconnected, a conduction path to the coil of the relay is blocked.

13. The image forming apparatus according to claim 11, wherein the heater has a conductor connected in series to the coil of the relay, and, when the conductor is disconnected, a conduction path to the coil of the relay is blocked.

14. The image forming apparatus according to claim 11, further comprising a cylindrical film being contact with the recording material bearing the image, wherein the heater is in contact with an inner surface of the film, and wherein the image formed on the recording material is heated by the heater through the film.

15. The image forming apparatus according to claim 14, further comprising a roller that forms a nip portion for nipping and conveying the recording material in cooperation with the heater through the film.

* * * * *